US009937529B1

(12) United States Patent
Beckhusen

(10) Patent No.: US 9,937,529 B1
(45) Date of Patent: Apr. 10, 2018

(54) DEVICE FOR CONTROLLING THE MOVEMENT OF AN ECCENTRIC MASS OF A VIBRATION INDUCING MECHANISM

(71) Applicant: Caterpillar Inc., Peoria, IL (US)

(72) Inventor: Jordan Beckhusen, Robinson, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/363,496

(22) Filed: Nov. 29, 2016

(51) Int. Cl.
*B06B 1/18* (2006.01)
*E01C 19/38* (2006.01)
*E02D 3/046* (2006.01)

(52) U.S. Cl.
CPC ..... *B06B 1/186* (2013.01); *E01C 19/38* (2013.01); *E02D 3/046* (2013.01)

(58) Field of Classification Search
CPC ..... B06B 1/186; E01C 19/38; E02D 3/146
USPC ..... 404/72, 113, 118, 133.1, 133.2; 74/87
See application file for complete search history.

(56) References Cited

U.S. PATENT DOCUMENTS

| | | | | |
|---|---|---|---|---|
| 2,989,869 | A * | 6/1961 | Hanggi | B06B 1/164 404/113 |
| 4,116,083 | A | 9/1978 | Gogins | |
| 4,367,054 | A * | 1/1983 | Salani | E01C 19/286 366/116 |
| 4,580,456 | A * | 4/1986 | Takano | B06B 1/164 366/128 |
| 4,830,534 | A * | 5/1989 | Schmelzer | B06B 1/164 404/117 |
| 5,340,233 | A | 8/1994 | Motl | |
| 6,808,336 | B2 | 10/2004 | Fervers et al. | |
| 7,121,762 | B2 * | 10/2006 | Quenzi | E01C 19/006 404/114 |
| 9,487,924 | B2 * | 11/2016 | Bertz | E01C 19/38 |
| 2015/0225909 | A1 * | 8/2015 | Bertz | E01C 19/4853 404/102 |

* cited by examiner

*Primary Examiner* — Raymond W Addie
(74) *Attorney, Agent, or Firm* — Law Office of Kurt J. Fugman LLC

(57) ABSTRACT

A method for adjusting the position of an eccentric mass from the axis of rotation of a mechanism comprises rotating an eccentric mass about an axis of rotation, and moving the eccentric mass closer or further away from the axis of rotation solely by the changing the speed of rotation of the eccentric mass about the axis of rotation.

20 Claims, 18 Drawing Sheets

DEVICE FOR CONTROLLING THE MOVEMENT OF AN ECCENTRIC MASS OF A VIBRATION INDUCING MECHANISM

TECHNICAL FIELD

The present disclosure relates to vibratory plate compactors. More particularly, the present disclosure is related to a vibratory plate compactor uses hydraulic fluid to power the vibration mechanism.

BACKGROUND

Vibratory compactors are routinely used in the construction industry and the like to compact soil or other work surfaces. These are often attached to mobile machines that include a cab that houses an operator that controls the operation of the vibratory compactor. These compactors often include a vibration mechanism such as an eccentric device that causes a plate to move up and down in a rapid or vibratory manner to effectuate the flattening of the work surface. The vibration mechanism is often hydraulically powered.

In many applications, the eccentric device includes an eccentric mass that is coupled to a shaft, which creates the desired vibrations. It is often desirable to start compacting loose dirt using low frequency and high amplitude oscillations while it is more desirable to progress to a higher frequency lower amplitude over time to produce soil that is tightly compacted.

Looking now at FIG. 1, a perspective view is shown of a machine 100 using a vibratory plate compactor assembly 200 according to a prior art design used to compact soil 128. The machine 100 that is compatible with a vibratory plate compactor assembly 200, that is to say, a coupling device 102 is provided so that the vibratory plate compactor assembly 200 may be attached to the machine and be controlled by the machine 100. In this embodiment, the coupling device 102 is located at the free end 104 of the boom 106 opposite the end 108 of the boom 106 that is attached to the turn table 130 of the machine 100. The machine 100 further comprises a controller 110, a motor 112, a wheel or track undercarriage 114 that is driven by the motor 112, and the vibratory plate compactor assembly 200 that is attached to the boom 106 of the machine 100 using the coupling device 102 as already mentioned. The controller 110 is in communication or operative association with the controls 116 provided in the cab 118 so that the operator may control the movement and function of various parts and systems of the machine 100.

More specifically, the machine 100 depicted in FIG. 1 is a large excavator but it is contemplated that other machines such as backhoes and the like could also use a vibratory plate compactor assembly 200 according to any embodiment of the present disclosure. Furthermore, the machine 100 is mobile on a track driven undercarriage 114 but a more conventional wheel or tire type undercarriage may also be used that is powered by the motor 112. For this machine 100, the motor 112 comprises an internal combustion engine but other motors such as an electric motor could be used for other embodiments. In addition, hydraulic hoses 120 connect the cylinders 122 that move the linkage members 124 of the boom 106 to a hydraulic manifold 126. Similarly, hydraulic hoses 120' connect the vibration mechanism 202 of the vibratory plate compactor assembly 200 to the manifold 126 (shown in hidden lines). A hydraulic pump (not shown) provides the hydraulic fluid necessary to rotate or otherwise drive the eccentric mechanism 204 that is part of the vibration mechanism 202. The movement of the boom 106 and powering of the vibration mechanism 202 may be achieved by other devices or methods in other embodiments such as by mechanical or electrical power, etc.

Turning now to FIG. 2, the coupling device 102 that connects the vibratory plate compactor assembly 200 to the machine 100 can be seen more clearly as well as the hydraulic hoses 120' that connect the vibration mechanism 202 to the hydraulic manifold 206 (shown by hidden lines) of the assembly 200 and system of the machine via hoses 120. The assembly includes an adapter subassembly 208 that is attached to the top plate 210 of the assembly 200 using fasteners, welding, etc. The adapter subassembly 208 includes a first side plate 220 with two ear portions 212 that define pin receiving bores 214 and a second side plate 216 with two ear portions 218 that define pin receiving bores that are aligned concentrically with the pin receiving bores 214 of the first side plate 220. Only one side may be clearly seen as the other side is obstructed by the boom 106 of the machine, but it is to be understood that both sides may be similarly constructed. Pins 222 that are part of the coupling device 102 of the machine extend through the bores 214 to hold the adapter subassembly 208 and vibratory plate compactor assembly 200 to the boom 106 of the machine 100. In some embodiments, the coupling device 102 may be a quick change coupling mechanism but this might not be the case for other embodiments. In some cases, the assembly 200 may be permanently attached to the machine 100.

Now referring to FIGS. 2 and 3, the vibratory plate compactor assembly 200 comprises an upper portion 224, a lower portion 226 that is movably attached to the upper portion 224 and that includes a compacting plate 244, a vibration mechanism 202 operatively associated with the lower portion 226 for vibrating the lower portion 226, a plurality of isolation mounts 240 and a hydraulic hose 120' that runs from the manifold 206, which is attached to the remote side of the upper portion 224 of the compactor 200 that does not move, to the vibration mechanism 202 that is on the lower portion 226 of the compactor 200 that does move. The vibration mechanism 202 is supported in the bores of the support plates 230 of the lower portion 226.

As mentioned previously, it is desirable to adjust the type of vibrations provided by the compactor plate. This prior art device just described lacks this ability. One method of adjusting the vibrations is to move the eccentric mass further or closer from the rotating shaft so that the amplitude is adjusted. Preferably, the mass is initially farther from the shaft at low speeds and closer to the shaft at higher speeds. Currently, complex mechanical or electrical systems may be able to achieve this but it is desirable to adjust the position of the eccentric mass using only the shaft speed if possible without use of complex mechanical or electrical systems.

SUMMARY OF THE DISCLOSURE

An apparatus for controlling the movement of an eccentric mass of a mechanism is provided. The apparatus comprises a housing defining a first plurality of channels and a second plurality of channels lacking fluid communication with the first plurality of channels within the housing, a shaft defining an axis of rotation for the apparatus, and a hydraulic cylinder defining an interior space and a longitudinal axis perpendicular to the axis of rotation, the cylinder being attached to the housing, the cylinder including a piston disposed in the interior space of the cylinder and configured to move along the longitudinal axis. The piston divides the hydraulic cylinder into extend and retract volumes and the first plurality of channels is at least partially in fluid communication with the extend volume and the second plurality of channels is at least partially in fluid communication with the retract volume.

An apparatus for controlling the movement of an eccentric mass of a vibration inducing mechanism is provided. The apparatus comprises an upper portion, a lower portion that is movably attached to the upper portion and that includes a compacting plate, a first support plate defining a first bore, and a second support plate defining a second bore, and a vibration mechanism operatively associated with the lower portion for vibrating the lower portion. The mechanism includes a rotating housing defining a first plurality of channels and a second plurality of channels lacking fluid communication with the first plurality of channels within the housing, a stationary shaft defining an axis of rotation for the rotating housing, a first free end and a second free end, a first axle portion extending from the rotating housing and defining a first central bore and a first free end, a second axle portion extending from the rotating housing and defining a second central bore and a second free end, and a hydraulic cylinder defining an interior space and a longitudinal axis perpendicular to the axis of rotation, the cylinder being attached to the housing, the cylinder including a piston disposed in the interior space of the cylinder and configured to move along the longitudinal axis. The piston divides hydraulic cylinder into extend and retract volumes and the first plurality of channels is at least partially in fluid communication with the extend volume and the second plurality of channels is at least partially in fluid communication with the retract volume, and the shaft is disposed in the first central bore of the first axle portion, creating an annular inlet that is in fluid communication with the first and second plurality of channels.

A method for adjusting the position of an eccentric mass from the axis of rotation of a mechanism is provided. The method comprises rotating an eccentric mass about an axis of rotation, and moving the eccentric mass closer or further away from the axis of rotation solely by the changing the speed of rotation of the eccentric mass about the axis of rotation.

DETAILED DESCRIPTION

Figure 1:
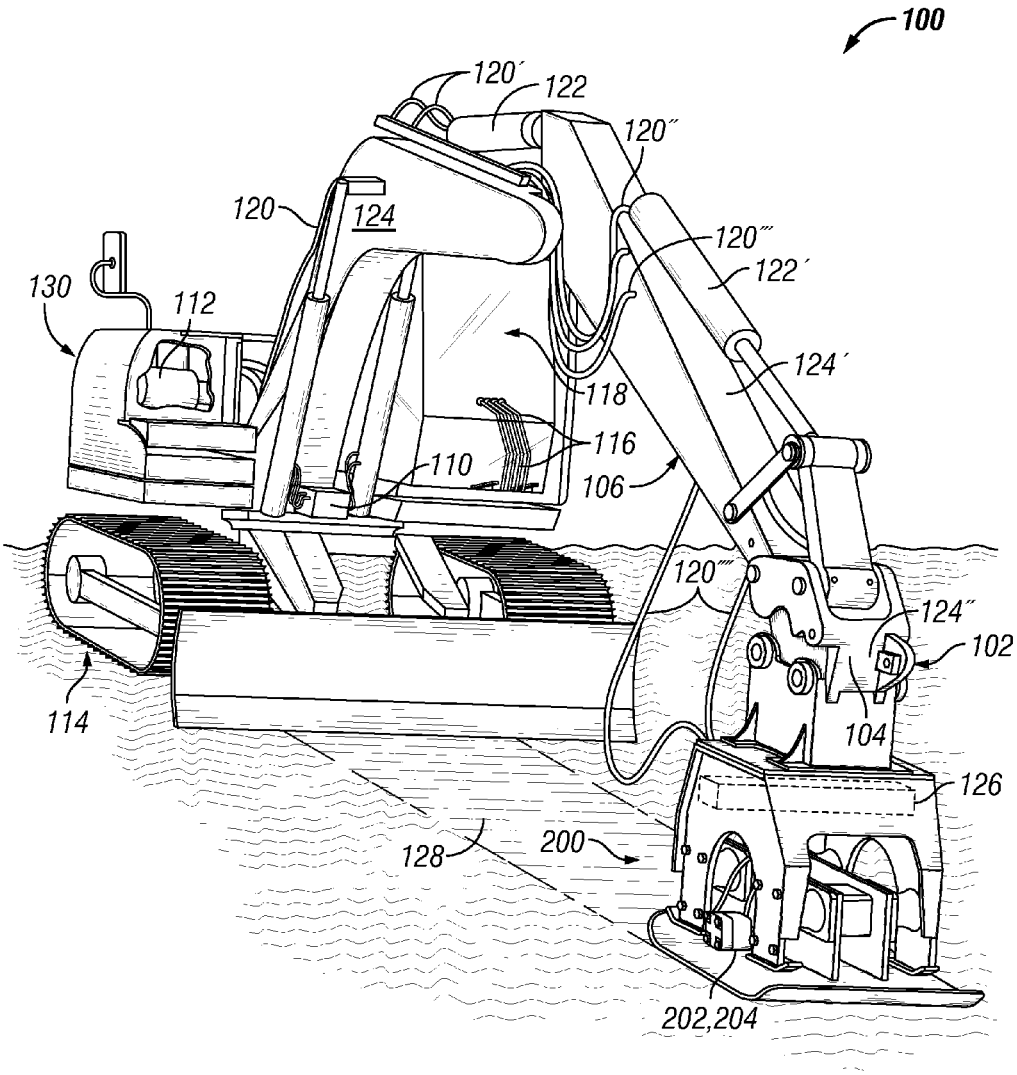
FIG. 1 (Prior Art)
FIG. 1 is a perspective view of a machine using a vibratory plate compactor assembly as known in the art.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides various embodiments of a vibration mechanism that eliminates the need for a spline, key or other coupling device to connect an eccentric mass to a shaft and that also provides a way to convey fluid to an eccentric mass moving device. While the mechanism is useful as a vibration mechanism, other uses are possible as will be described herein. Also, various modifications to the construction of the mechanism are possible and will be described. Initially, the mechanism will be described from the outside of the mechanism toward the inside of the mechanism. The mechanism will then be described starting with the inside of the mechanism toward the outside of the mechanism. Finally, details of various embodiments of a device for controlling the movement of an eccentric mass of a vibration inducing mechanism or other similar mechanism will be discussed.

Looking at FIG. 4 thru 7, a mechanism 300 according to an embodiment of the present disclosure is shown. The mechanism 300 includes a rotating housing 302, and a stationary shaft 304 defining a radial direction R304 and a cylindrical axis A304, a first free end 306 and a second free end 308 disposed along the axis A304. The rotating housing 302 is so called as it may rotate about the axis A304 of the stationary shaft 304 as will be described later herein. A first axle portion 310 extends from the rotating housing 302 and defines a first central bore 312 and a first free end 314 while a second axle portion 316 extends from the other side of the housing 302, defining a second central bore 318 and a second free end 320. The stationary shaft 304 is disposed in the first and the second central bores 312, 318 and the first free end 306 of the stationary shaft 304 extends past the free end 314 of the first axle portion 310 and the second free end 308 of the stationary shaft 304 extends past the second free end 320 of the second axle portion 316. Accordingly, the first and second axle portions are concentric with the stationary shaft and with each other.

Figure 5:
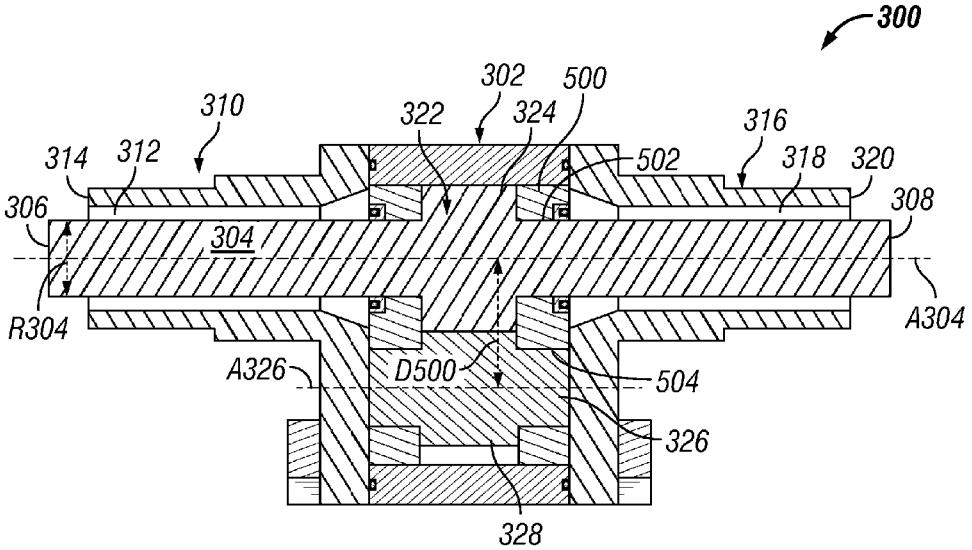
FIG. 5 is a side cross-sectional view of the rotating hydraulic gear motor of FIG. 4 taken along lines 5-5 thereof, illustrating the flow of hydraulic fluid to the gear motor housing chamber.
Figure 6:
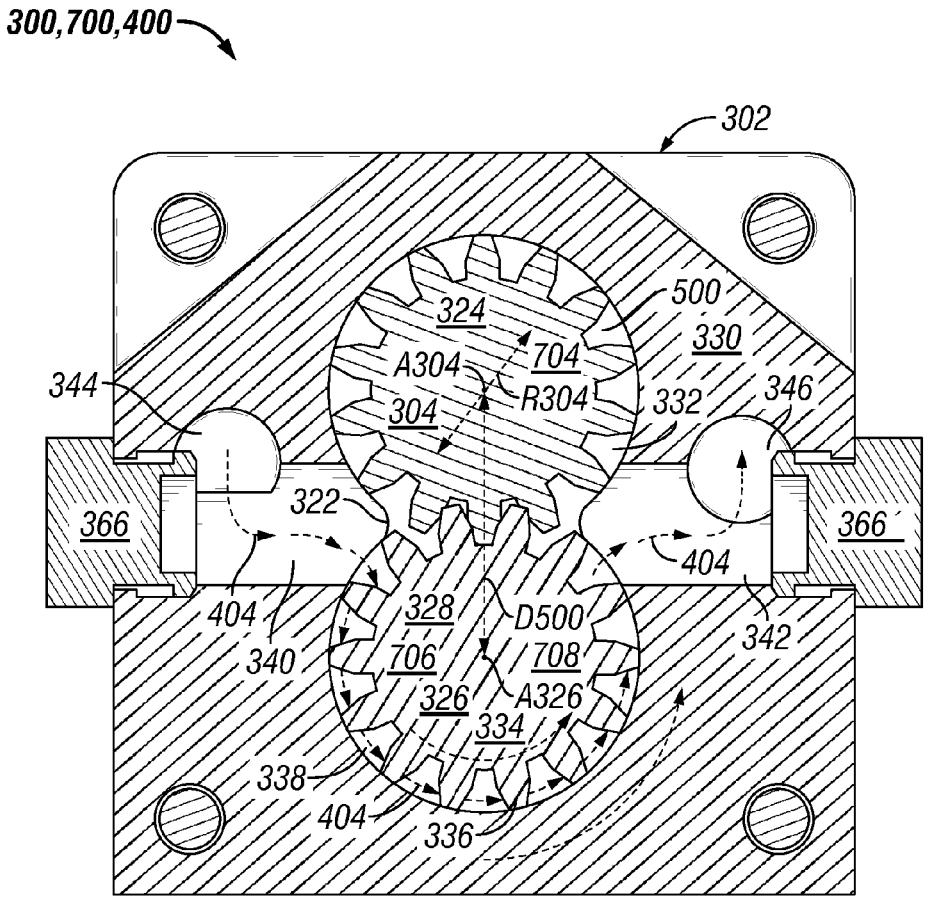
FIG. 6 is a front cross-sectional view of the rotating hydraulic gear motor of FIG. 4 taken along lines 6-6 thereof, showing the circulation of hydraulic fluid through the annular channel between the rotating gear and the housing, causing the gear to rotate.
Figure 7:
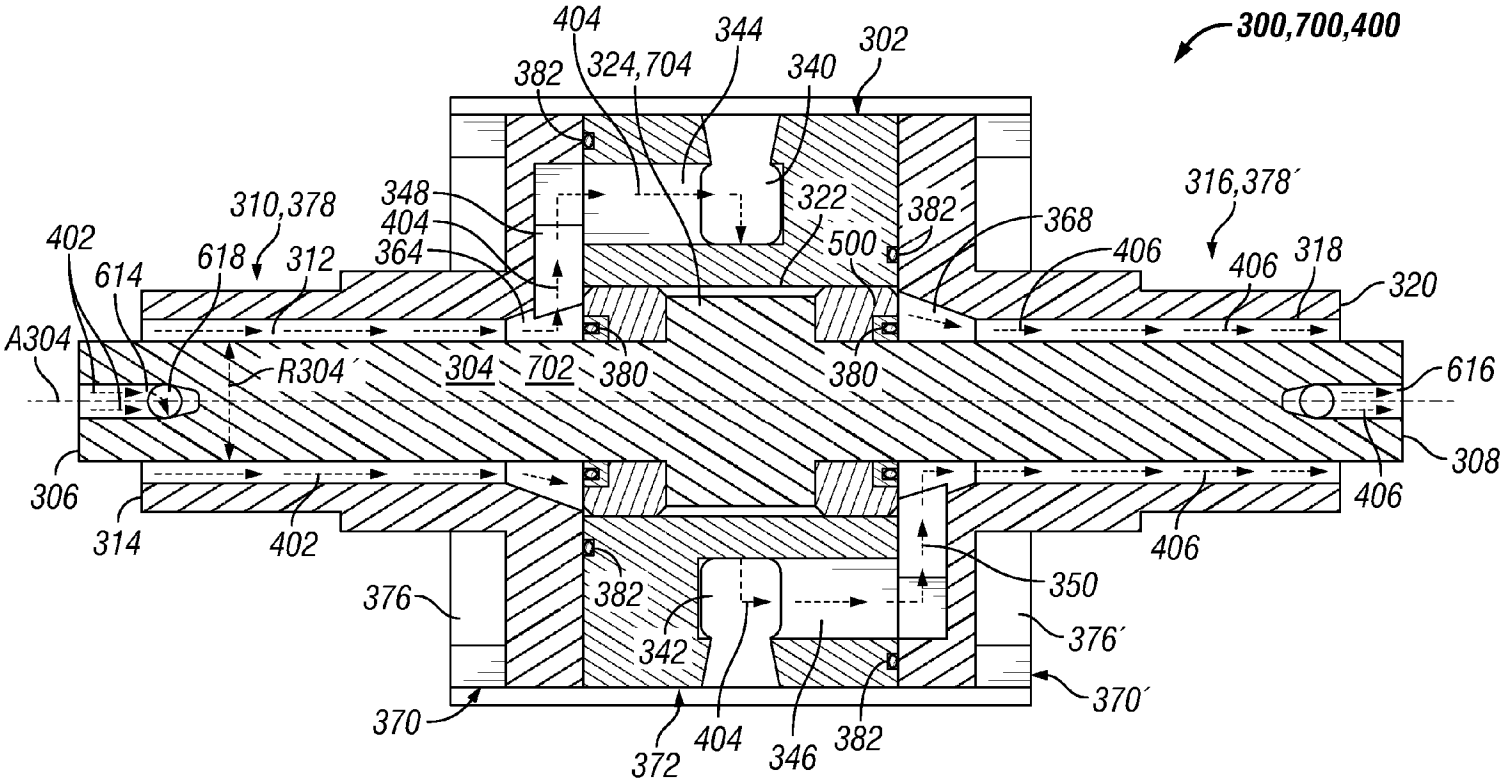
FIG. 7 is a top cross-sectional view of the rotating hydraulic gear motor of FIG. 4, taken along lines 7-7 thereof, illustrating the flow of hydraulic fluid from the hydraulic fluid inlet, to the housing chamber where flows causing the gear to rotate, eventually passing past the rotating gear to an outlet channel that leads to the hydraulic fluid outlet.

As best seen in FIGS. 5 thru 7, the housing 302 defines a housing chamber 322 and the mechanism 300 further comprises a fixed gear 324 attached to the stationary shaft 304, a rotating shaft 326 and a planetary gear 328 attached to the rotating shaft 326, the planetary gear 328 meshing with the fixed gear 324. A yoke bushing member 500 is provided, defining a first aperture 502 and a second aperture 504 that are spaced away from each other a predetermined distance D500, wherein the stationary shaft 304 is disposed in the first aperture 502 of the yoke bushing member 500 and the rotating shaft 326 is disposed in the second aperture 504. The yoke bushing member 500, the rotating shaft 326, the fixed gear 324, the planetary gear 328 and a portion of the fixed shaft 304 are disposed in the housing chamber 322.

Focusing on FIG. 6, the rotating shaft 326 defines an axis of rotation A326 and a plane 330 perpendicular to the axis A326 and a portion of the housing chamber 322 defines a perimeter 332 in the plane 330 that has a substantially figure eight configuration. The rotating planetary gear 328 comprises a hub 334 and teeth 336 extending from the hub 334, wherein the teeth 336 are disposed adjacent a portion of the perimeter 332 of the housing chamber 322 with a small clearance therebetween, the hub portion 334 and the perimeter 332 of the housing chamber 322 defines an annular channel 338.

Looking at FIGS. 6 and 7 together, the housing 302 defines a first bore 340 that extends from the housing chamber 322 in a first direction perpendicular to the axis A326 of the rotating shaft 326 and the housing 302 further defines a second bore 342 that extends from the housing chamber 322 in a second direction that is opposite the first direction. The housing 302 further defines a third bore 344 extending in a third direction that is parallel to the axis A326 of the rotating shaft 326 and a fourth bore 346 extending in a fourth direction that is opposite the third direction, wherein the third bore 344 is in fluid communication with the first bore 340 and the fourth bore 346 is in fluid communication with the third bore 344. Finally, the housing 302 further defines a fifth bore 348 that extends in the same direction as the second bore 342 and a sixth bore 350 that extends in the same direction as the first bore 340. The fifth bore 348 is in fluid communication with the third bore 344 and the sixth bore 350 is in fluid communication with the fourth bore 346. Lastly, the fifth bore 348 is in fluid communication with the central bore 312 of the first axle portion 310 while the sixth bore 350 is in fluid communication with the central bore 318 of the second axle portion 316.

Figure 4:
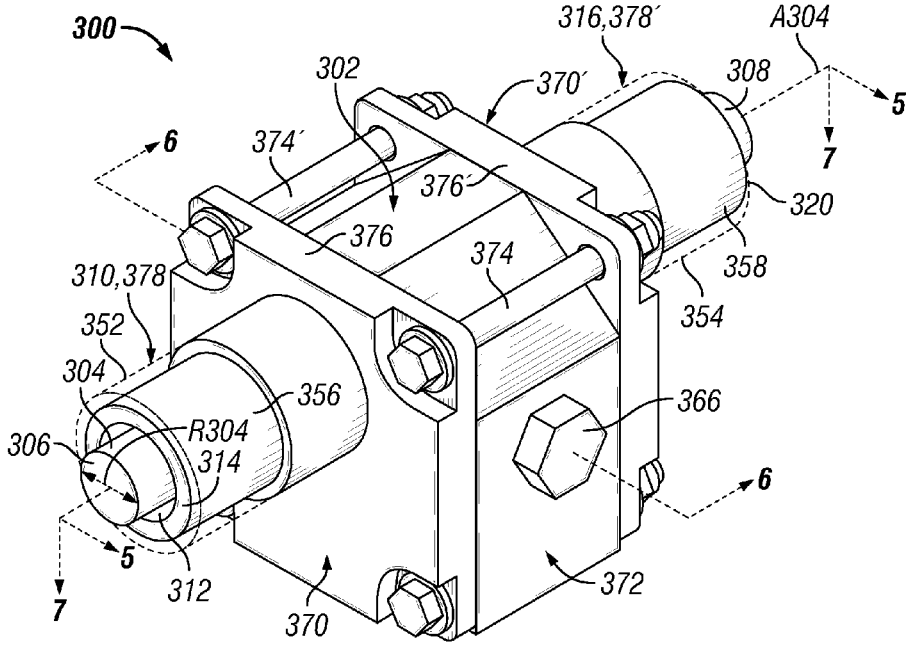
FIG. 4 is a perspective view of a vibration mechanism using a rotating hydraulic gear motor according to an embodiment of the present disclosure, showing the hydraulic fluid inlet.

Referring now to FIG. 4, the mechanism may further comprise a first support bearing 352 and a second support bearing 354. The first axle portion 310 may define a first outer circumference 356 and the second axle portion 316 defines a second outer circumference 358. The first support bearing 352 may be disposed about the first outer circumference 356 spaced away along the axis A304 from the housing 302 and the second support bearing 354 may be disposed about the second outer circumference 358 spaced away from the housing 302 along the axis A304.

Figure 2:
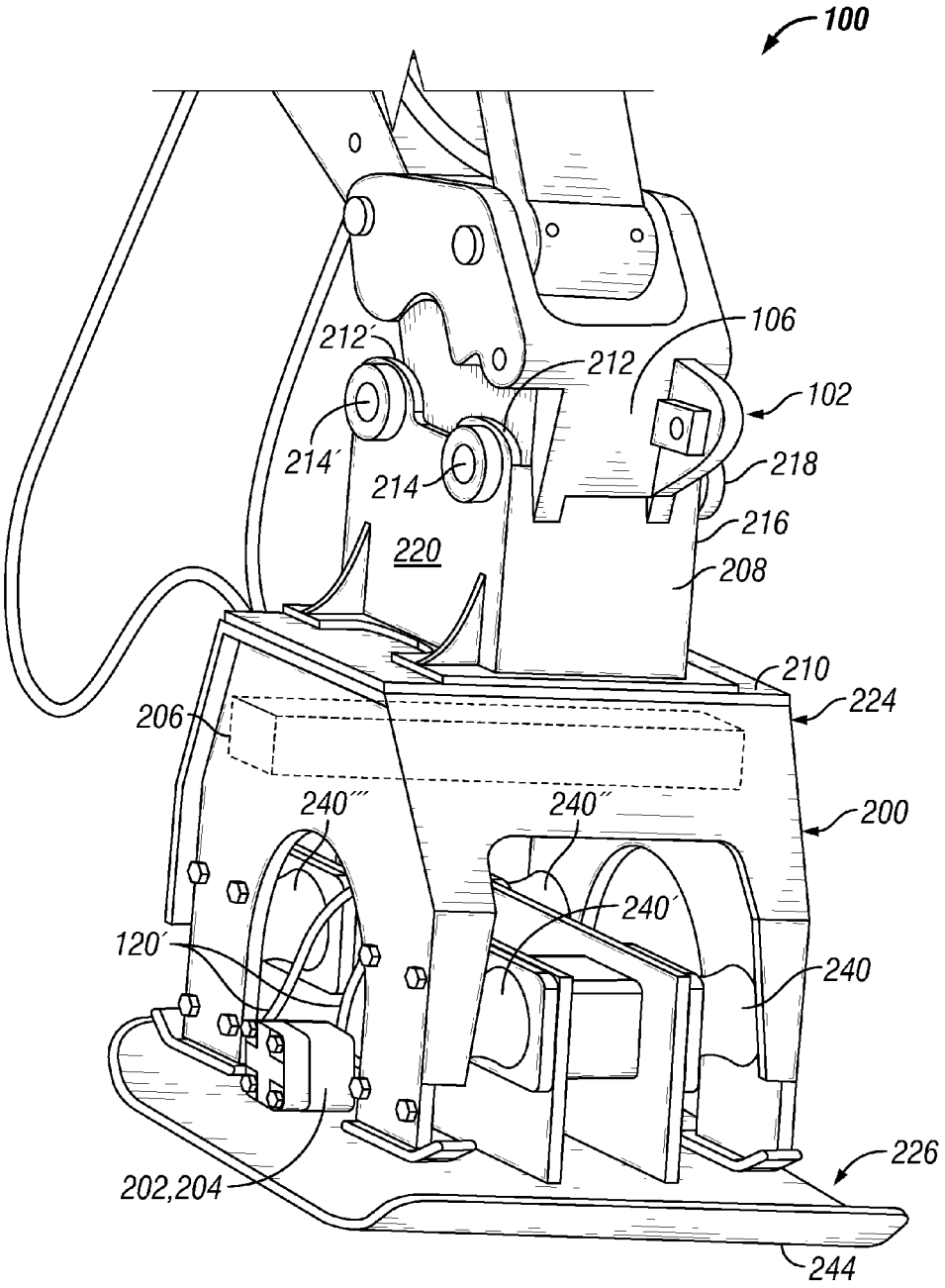
FIG. 2 (Prior Art)
FIG. 2 is an enlarged detail view of the vibratory plate compactor assembly connected to the boom of the machine of FIG. 1.
Figure 3:
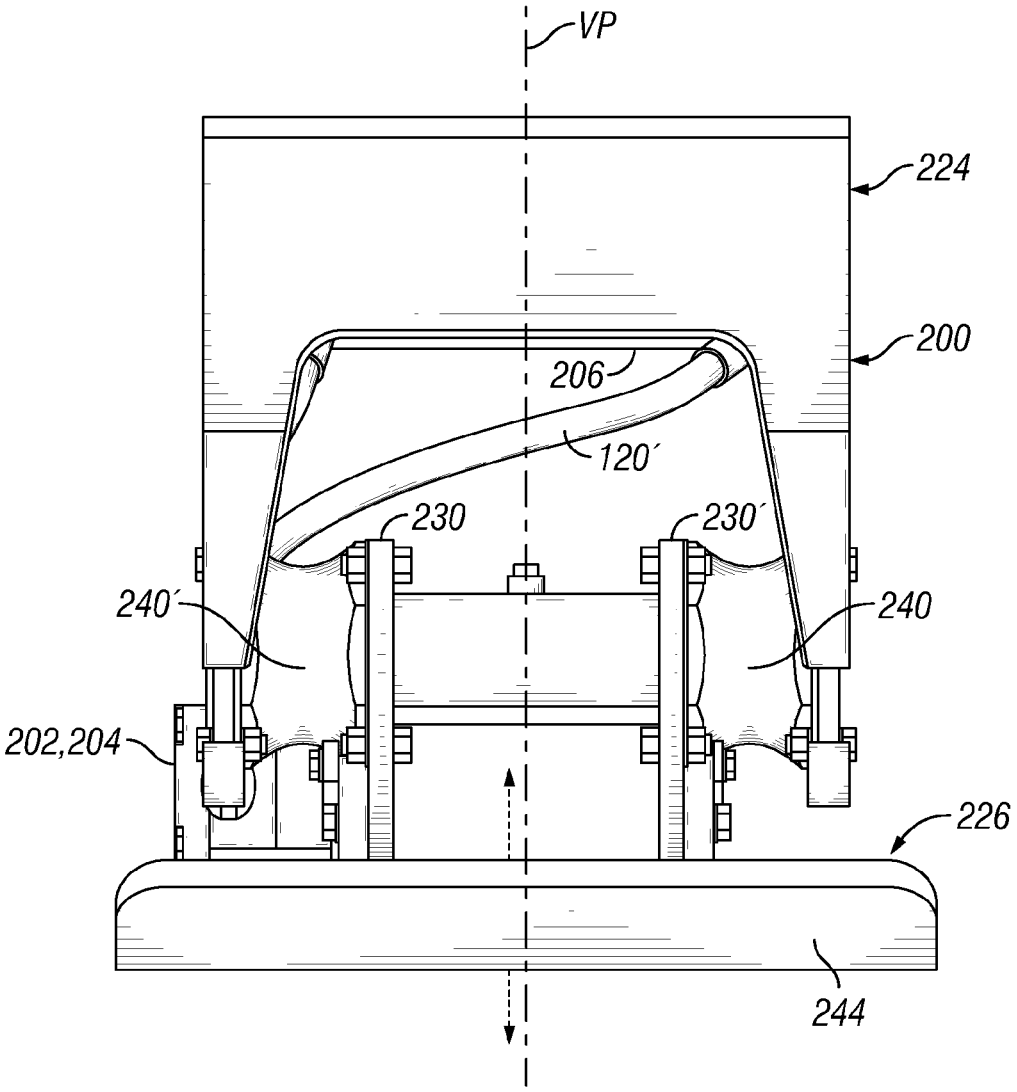
FIG. 3 (Prior Art)
FIG. 3 is a front view of the compactor assembly of FIG. 2, removed from the boom of the machine, better illustrating how the vibration mechanism is supported by support plates of the compactor assembly.

When the mechanism 300 is employed as a vibration mechanism 602, it may be attached to a vibratory plate compactor assembly 600, such as that disclosed in FIG. 2. It is to be understood that in some applications, the construction of the vibratory plate compactor assembly may need to be adjusted to accommodate the new mechanism. A new vibratory plate compactor assembly 600 using a vibration mechanism 602 according to an embodiment of the present disclosure may be described as follows with reference to FIGS. 2 and 8. The assembly 600 may comprise an upper portion 224 and a lower portion 226 such as that shown in FIG. 2. As such, the lower portion 226 is movably attached to the upper portion 224 and includes a compacting plate 244.

Figure 8:
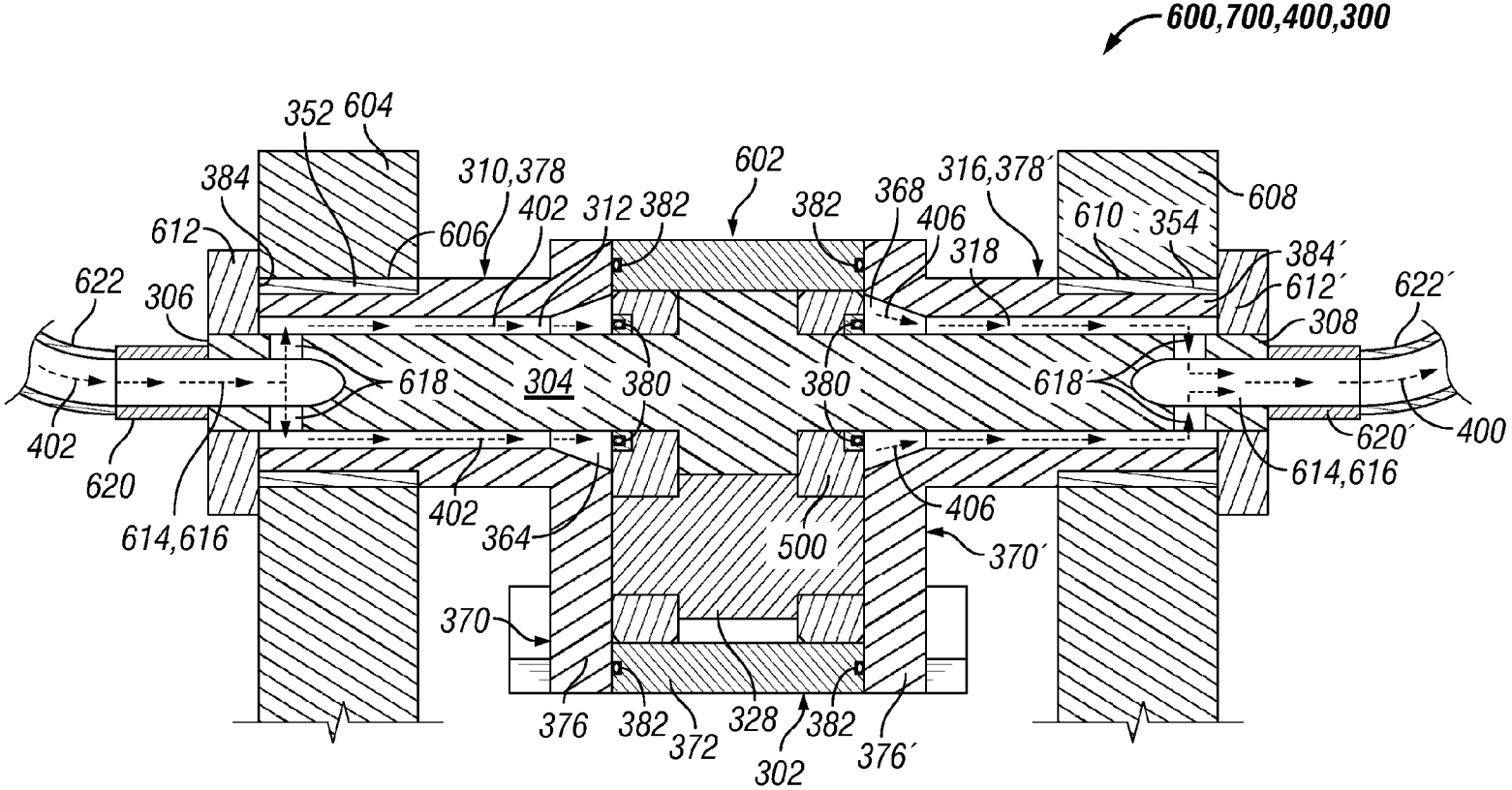
FIG. 8 is the same view as FIG. 5 except the flow of the hydraulic fluid from the housing chamber to the hydraulic fluid outlet is shown.

As best seen with reference to FIG. 8, a first support plate 604 defining a first bore 606, and a second support plate 608 defining a second bore 610 are provided. The support bearings 352, 354 and axle portions 310, 316 are inserted into this structure for proper support. A flag plate 612 is welded onto a free end 306, 308 of the stationary shaft 304 and bolted to a support plate 604, 608, preventing the shaft 304 from moving. A hydraulic inlet 614 or outlet 616 may be provided that is drilled into the end 306, 308 of the shaft 304 and connected to the central bore 312, 318 via cross-bores 618 in the shaft 304. A fitting 620 may be attached to the shaft 304 from which a fluid conduit 622 may be connected to allow the flow of hydraulic fluid. The movement of the fluid causes the housing 302 to rotate, causing the plate 244 to move up and down. Hence, the vibration mechanism 602 is operatively associated with the lower portion 226 (see FIG. 2) for vibrating the lower portion 226. The exact manner in which the mechanism 602 provides this vibration will be described later herein.

Referring back to FIGS. 6 and 7, a mechanism 700 according to another embodiment of the present disclosure may be described in more general terms as follows. The mechanism 700 comprises a long shaft 702 and a first gear 704 attached to the long shaft 702, a short shaft 706 and a second gear 708 attached to the short shaft 706. The second gear 708 meshes with the first gear 704. There is a yoke bushing member 500 defining a first aperture 502 and a second aperture 504 that are spaced away from each other a predetermined distance D500 and the long shaft 702 is disposed in the first aperture 502 of the yoke bushing member 500 and the short shaft 326 is disposed in the second aperture 504. When used in a compactor assembly, the rest of this mechanism may be described in a similar manner as mechanism 300. That is to say, the construction of the housing 302 and the axle portions 310, 316 are the same as has been described regarding mechanism 300. The housing chamber 322 contains the yoke bushing member 500, the short shaft 706, the first gear 704, the second gear 708 and a portion of the long shaft 702. Also, the hydraulic circuit is essentially the same.

More particularly, the same network of bores establishes a hydraulic circuit that allows the fluid to flow through the first axle portion 310, to the housing chamber 322 causing the second gear 708 to rotate about the first gear 704, which in turn, causes the housing 302 to rotate about the axis A304 of the long shaft 702. Then, the hydraulic fluid exits the housing 302 through the second axle portion 316.

Figure 9:
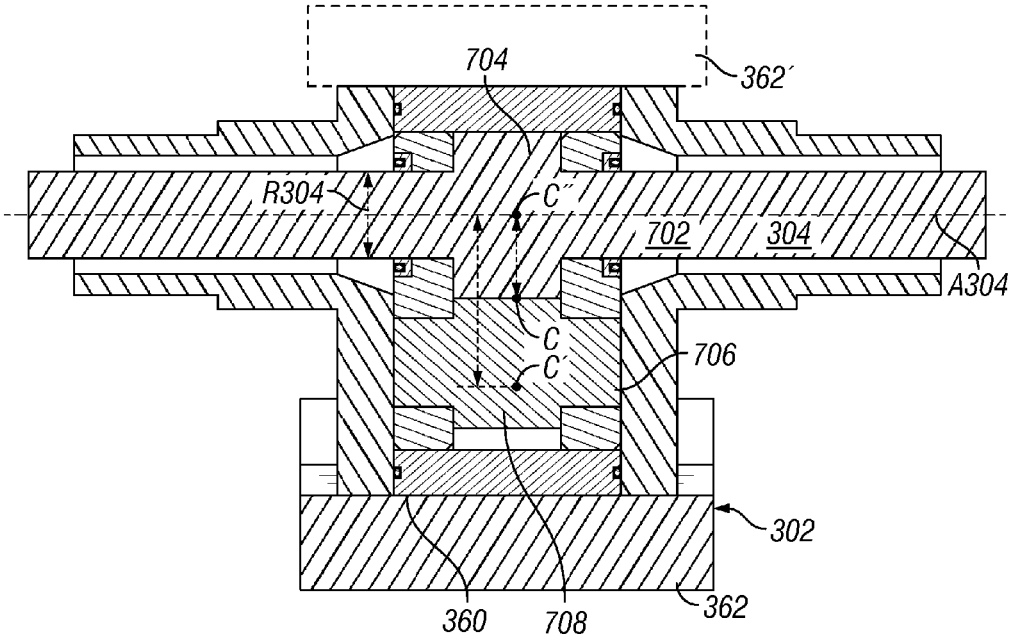
FIG. 9 is the same view as FIG. 5 or 7 except an extra eccentric mass has been added to the radial extremity of the motor housing to enhance the amount of vibration created as the housing rotates about the fixed shaft.

When the mechanism is used as a vibration mechanism as shown in FIG. 9, the long shaft 702 is a stationary shaft, the first gear 704 is a fixed gear, the short shaft 706 is a rotating shaft, the second gear 708 is a planetary gear, and the stationary shaft 304 defines a radial direction R304 and an axis A304, wherein the mechanism defines a center of mass C that is spaced away from the axis A304 of the stationary shaft 304 along the radial direction R304. As a result, the rotation of the housing 302 causes the compactor plate to move up and down. The housing 302 defines a radial extremity 360 and the mechanism may further comprise an eccentric mass 362 attached proximate the radial extremity 360 via fastener, welding, etc. This moves the center of mass C' further down, increasing the propensity for the mechanism to vibrate the plate up and down. However, it is further contemplated that the eccentric mass 362' may be attached to the other side of the housing 302, closer to the axis of rotation A304, moving the center of mass C" nearer to or coincident with the axis of rotation A304, virtually eliminating the propensity of the mechanism to create vibrations.

FIGS. 11 thru 14, show an apparatus for controlling the movement of an eccentric mass of a mechanism such as a vibration mechanism. It is to be understood that FIGS. 11 thru 14 show additional features to those embodiments discussed thus far herein regarding FIGS. 4 thru 10. Accordingly, some of the features discussed previously herein are omitted from FIGS. 11 thru 14 but are to be understood to be present when necessary or desired.

Figure 11:
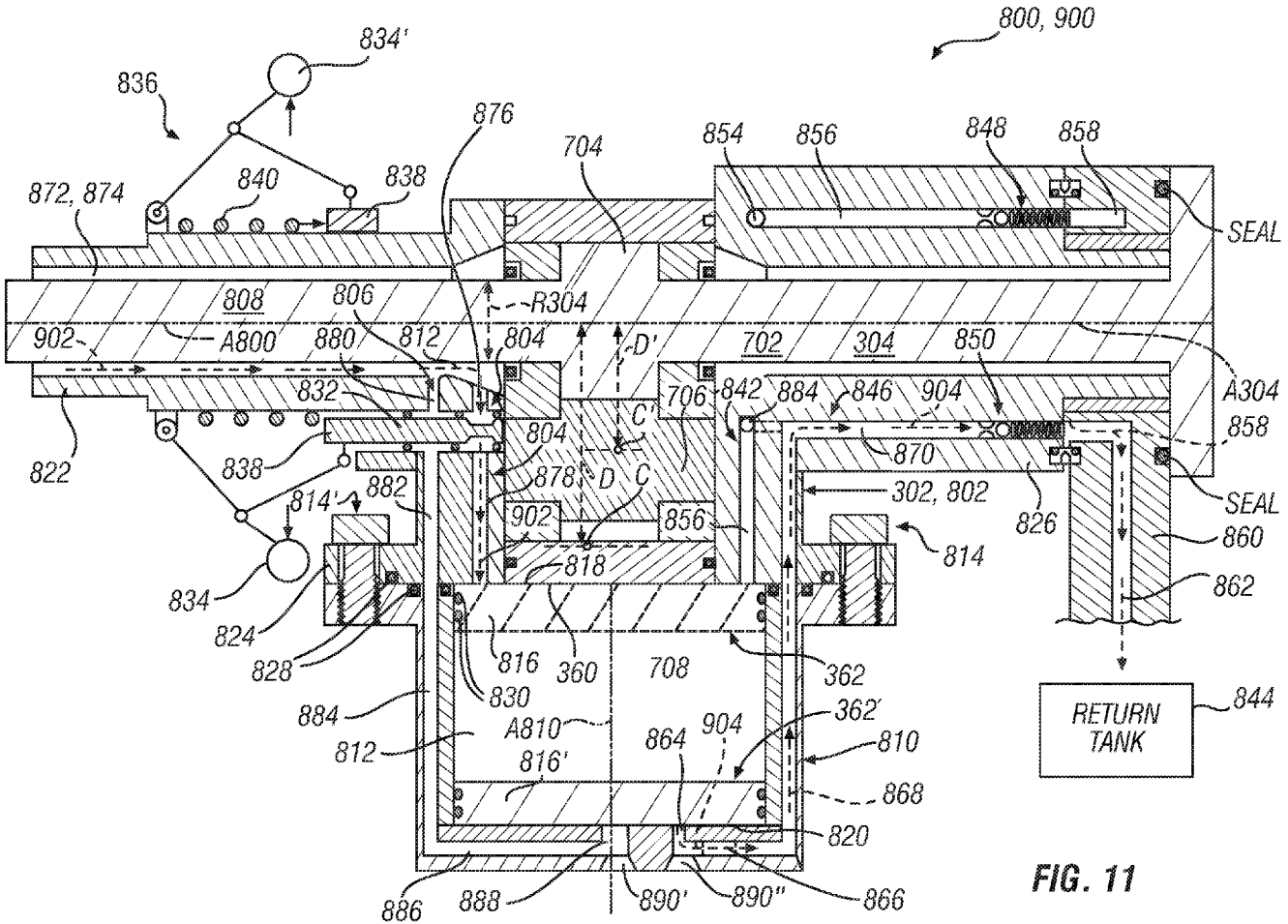
FIG. 11 is a side cross-sectional view of a device for controlling the movement of an eccentric mass according to an embodiment of the present disclosure using a control spool and a centrifugal governor mechanism.

Looking at FIG. 11, the apparatus 800 comprises a housing 802 defining a first plurality of channels 804 and a second plurality of channels 806 lacking fluid communication with the first plurality of channels 804 within the housing 802, a shaft 808 defining an axis of rotation A800 for the apparatus 800 (this axis may be parallel to the axis of the rotating shaft discussed earlier herein), and a hydraulic cylinder 810 defining an interior space 812 and a longitudinal axis A810 perpendicular to the axis of rotation A800. The cylinder 810 is attached to the housing 802 using a bolted connection 814 but may be integral with the housing in other embodiments. The cylinder includes a piston 816 disposed in the interior space 812 of the cylinder 810 and that is configured to move along the longitudinal axis A810. The piston 816 divides the hydraulic cylinder 810 into extend and retract volumes 818, 820 and the first plurality of channels 804 is at least partially in fluid communication with the extend volume 818 and the second plurality of channels 806 is at least partially in fluid communication with the retract volume 820.

It should be noted that the bolted connection 814 could be reversed compared to what is shown in FIG. 11 if clearance for inserting the fasteners between the first axle portion 822 and the flange 824 of the housing 802 or the second axle portion 826 and the flange 824 of the housing 802 is an issue. Also, a series of seals 828 are shown to prevent fluid from leaking from the hydraulic cylinder 810. It is contemplated that they could be part of a larger gasket if so desired. A set of seals 830 is also disposed on the circumference of the piston 816. These seals 830 may be of any type known or that will be devised in the art including cup seals, wiper seals, buffer seals, piston seals, etc.

The apparatus 800 further comprises a control spool 832 in fluid communication with the first and second plurality of channels 804, 806, and a centrifugal moving member 834 in operative association with the control spool 832, wherein the centrifugal moving member 834 is configured to move the control spool 832. For this particular embodiment, the apparatus 800 further comprises a centrifugal governor mechanism 836 proximate the first axle portion 822 wherein the centrifugal governor mechanism 836 includes the centrifugal moving member 834, a sleeve 838 connected to the control spool 832, and a spring 840, wherein the control spool 832 and the sleeve 838 are configured to move in a direction parallel with the axis of rotation A808. Hence, the centrifugal moving member 834 and the control spool 832 are disposed adjacent the first axle portion 822.

Looking now at the area adjacent the second axle portion 826 on the right side of FIG. 11, the housing 802 may further define a third plurality of channels 842 in fluid communication with the extend volume 818 and the return tank 844 and a fourth plurality of channels 846 in fluid communication with the retract volume 820 and the return tank 844. A first check valve 848 may be disposed in the third plurality of channels 842 and a second check valve 850 may be disposed in the fourth plurality of channels 846. More particularly, the third plurality of channels 842 includes a lower channel 852, at least one cross-bore or annular channel 854, and a upper channel 856 that is in fluid communication with the annular cavity 858 of a support member 860 as will be described in more detail later herein. The support member 860 also defines a vent passage 862 disposed adjacent the second axle portion 826. The vent passage 862 leads to the return tank 844 and is connected to the annular cavity 858.

Likewise, the fourth plurality of channels 846 includes a first downwardly extending hole 864, which is in fluid communication with the retract volume 820 of the hydraulic cylinder 810, located between the bottom of the hydraulic cylinder and the bottom of the piston 816'. The first downwardly extending hole 864 is in fluid communication with a second hole 866 extending parallel to the axis of rotation A800, which in turn, is in fluid communication with a third upward extending hole 868 that then connects to a fourth hole 870 extending in a direction parallel to the axis of rotation A800 that is also in fluid communication with the annular cavity 858 of the support member 860; and therefore, with the return tank 844.

Looking back now at the left side of the apparatus 800, the control spool 832 is configured to move from a first position (shown in FIGS. 11 and 12) where the first plurality of channels 804 are in fluid communication with the extend volume 818 and the second plurality of channels 806 at least partially lack fluid communication with the retract volume 820 and a second position (shown in FIGS. 13 and 14) where the second plurality of channels 806 are in fluid communication with the retract volume 820 and the first plurality of channels 804 at least partially lack fluid communication with the extend volume 818. With continued reference to FIG. 11, control is accomplished using a standard ball centrifugal governor mechanism 836 that includes a sleeve 838 that is directly attached to the control spool 832. At low rotational speeds, the force supplied by the governor spring 840 is sufficient to overcome the centrifugal force exerted by the centrifugal moving member 834 and keep the control spool 832 at the first position wherein the first plurality of channels 804 are in fluid communication with the extend volume 818 of the cylinder 810, located between the top of the piston 816 and the bottom of the housing 802.

As mentioned previously, the shaft 808 may be a stationary shaft and the apparatus 800 may further comprise a first rotating axle portion 822 defining a central aperture 872 and the shaft 808 is disposed in the central aperture 872, creating an annular inlet 874 that is in fluid communication with the first and second plurality of channels 804, 806. For this embodiment, the piston 816 serves the function of a movable eccentric mass 362 and alters the distance D from the center of gravity C of the apparatus 800 to the axis of rotation A800 as the piston 816 moves up and down.

The first plurality of channels 804 includes an upper channel 876 in direct fluid communication with the annular inlet 874 and a lower channel 878 separated from the upper channel 876 by the control spool 832. The lower channel 878 is in direction fluid communication with the extend volume 818 of the hydraulic cylinder 810. Similarly, the second plurality of channels 806 includes an upper channel 880 and a lower channel 882 separated by the control spool 832. The upper channel 880 is in direct fluid communication with the annular inlet 874 and the lower channel 882 is in direction fluid communication with a first hole 884 of the hydraulic cylinder 810 extending parallel with the longitudinal axis A810 of the hydraulic cylinder 810. The first hole 884 is in fluid communication with a second hole 886 extending parallel to the axis of rotation A800, which in turn, is in fluid communication with a third hole 888 extending upwardly in direct fluid communication with the retract volume 820 of the hydraulic cylinder 810. Any of the holes drilled for the apparatus may use a plugged end 890 if necessary to create the desired hydraulic circuit.

Figure 12:
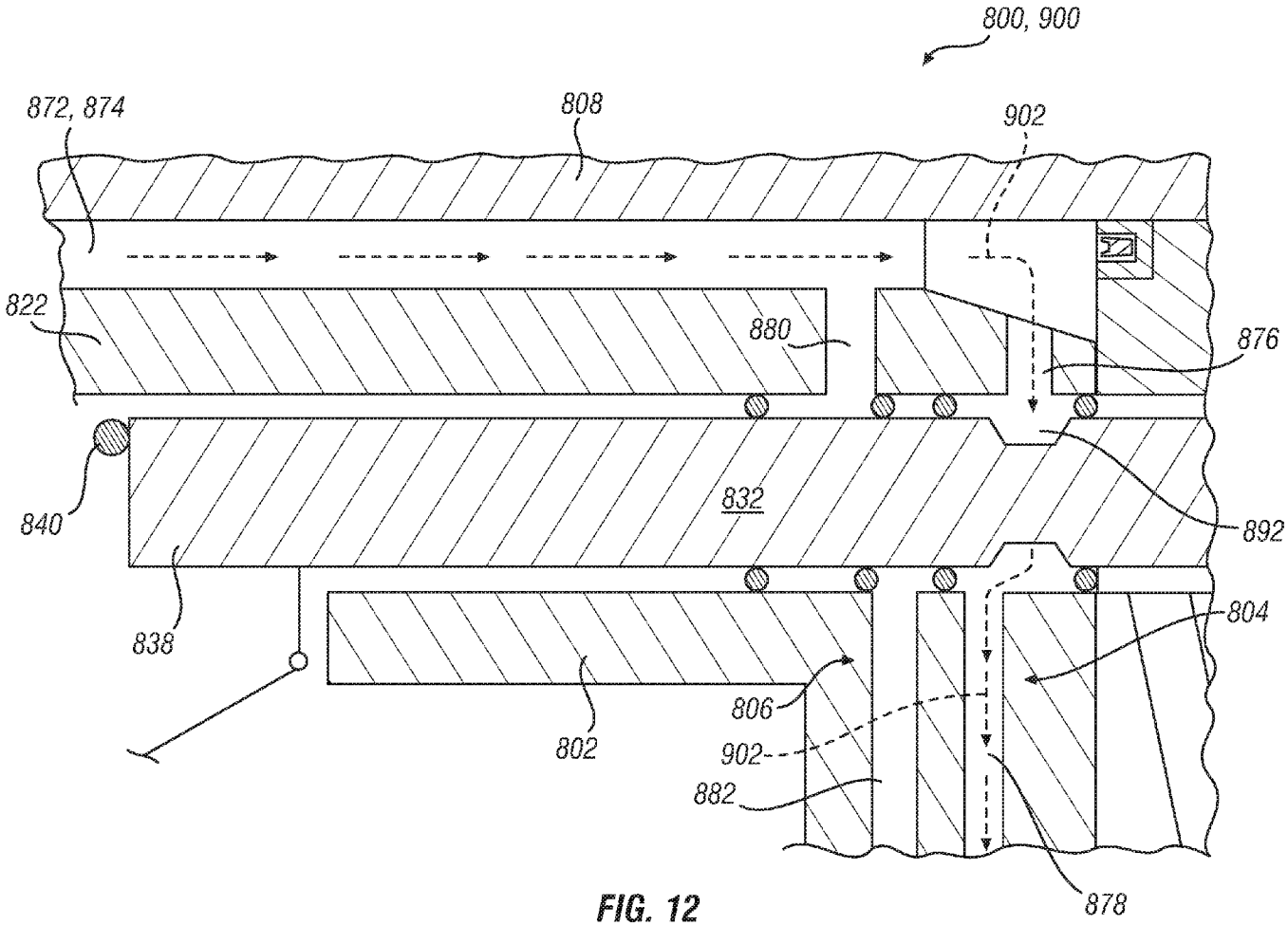
FIG. 12 is an enlarged detail view of the control spool of the device of FIG. 11, showing the control spool in a first position where fluid is conveyed to the extend volume of a piston, moving the piston to its furthest position from the axis of rotation of the vibration mechanism.

Operation of stage one of the apparatus 800, when the rate or speed of rotation of the apparatus 800 is relatively low, will now be explained with reference to FIGS. 11 and 12. First, a hydraulic circuit 900 is established where the fluid flows (see arrows 902) from the annular inlet 874, through the upper channel 876 of the first plurality of channels 804, past the control spool 838 via its circumferential groove 892, to the lower channel 878 and into the extend volume 818 of the cylinder 810. Hence, hydraulic force in addition to centrifugal force move the piston 816 from position 362 to position 362'. At the same time, air or hydraulic fluid in the retract volume 820 is forced through the fourth plurality of channels 846 (see arrows 904), overcoming the check valve 850 due to the pressure increase created by the downward moving piston 816. This fluid is then sent to the return tank 844.

It is contemplated that is some embodiments, only centrifugal force may be exerted on the piston as it moves downward. In such a case, resilient stop members may be placed in the extend volume to cushion the impact when the piston returns as will be described later herein.

Figure 13:
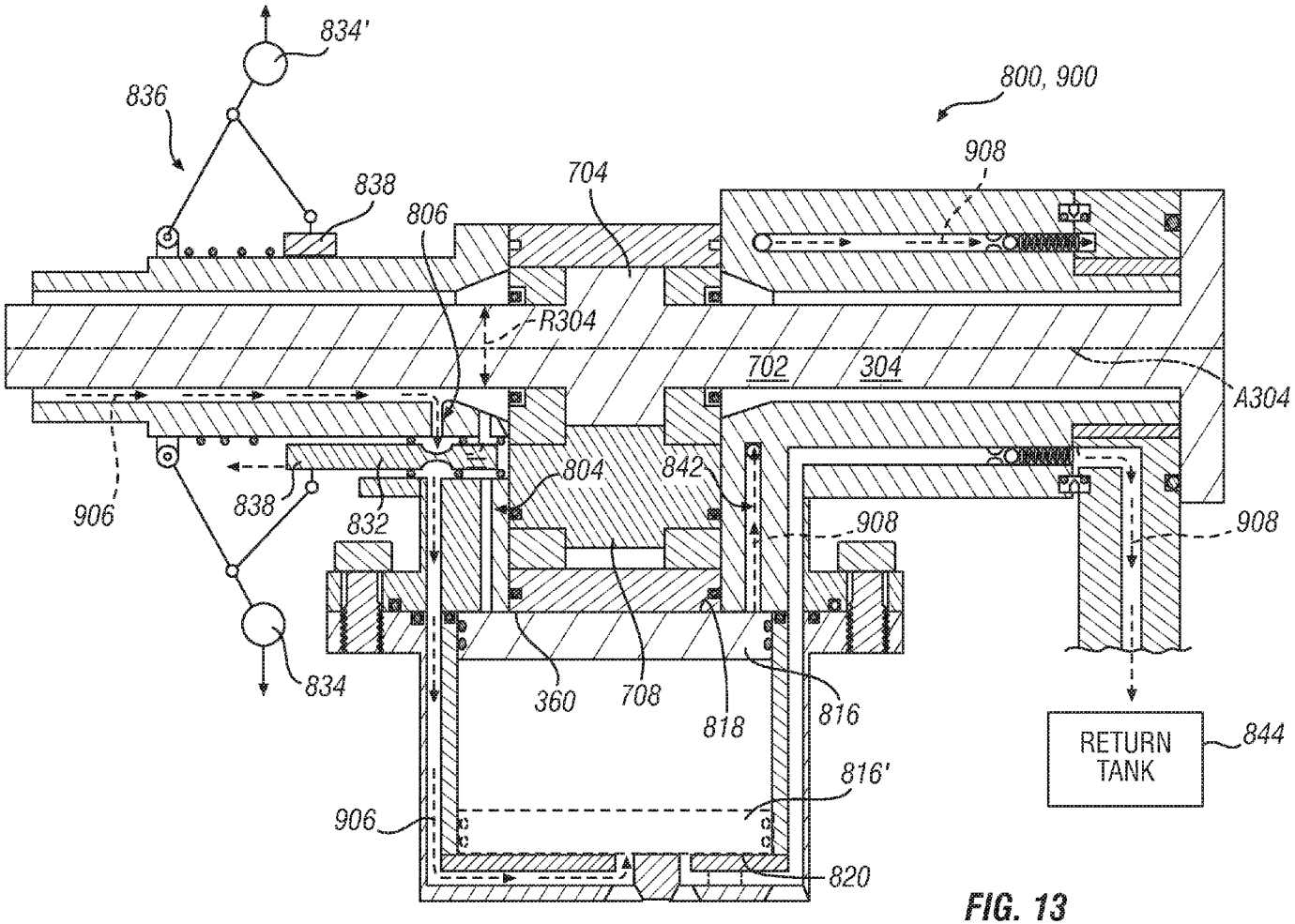
FIG. 13 is a side cross-sectional view of the device of FIG. 11 where the control spool has been moved to a second position by the centrifugal governor mechanism.
Figure 14:
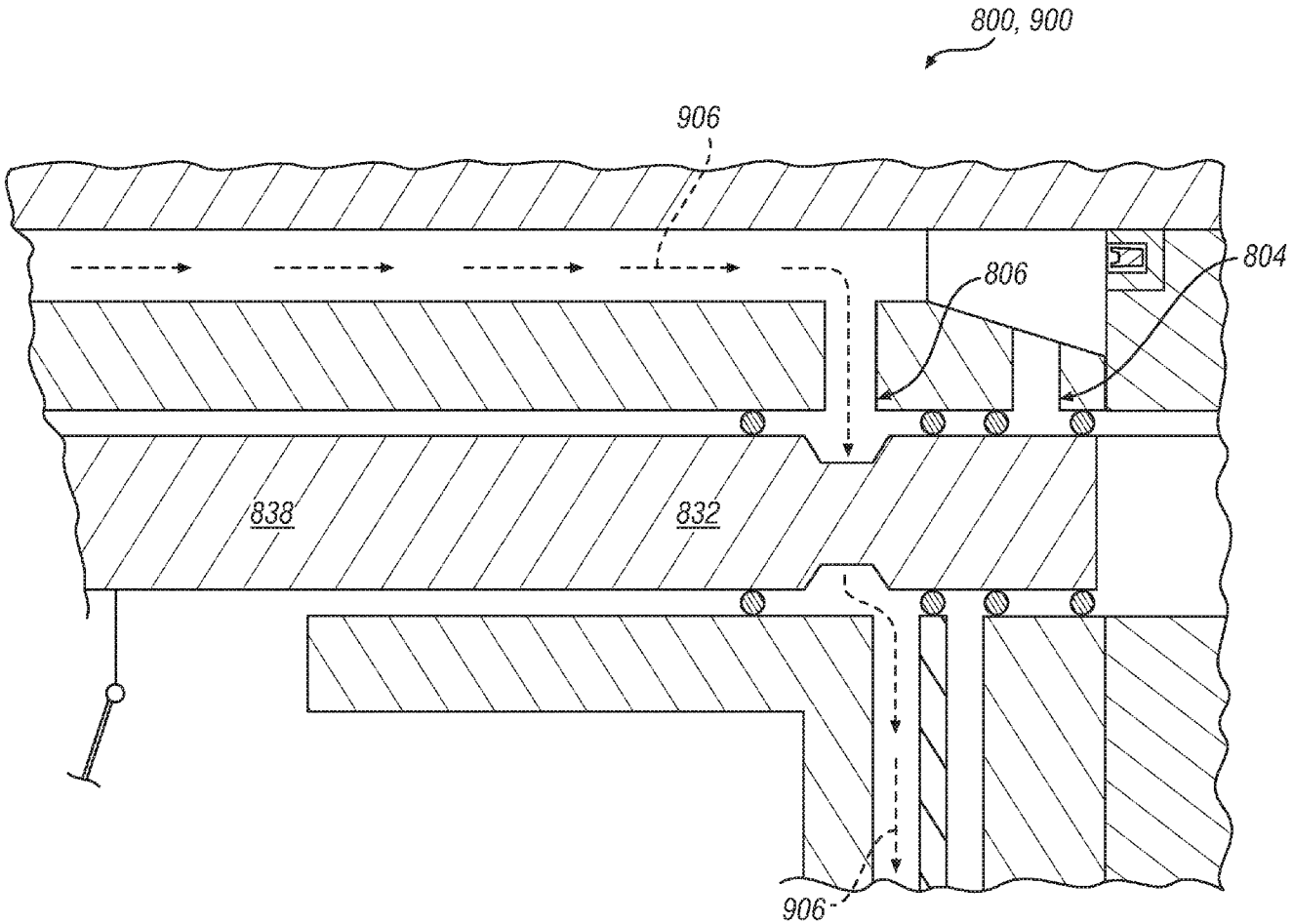
FIG. 14 is an enlarged detail view of the control spool of FIG. 13, showing the control spool in the second position where fluid is conveyed to the retract volume side of the piston, moving the piston to its closest position from the axis of rotation of the vibration mechanism.
Figure 15:
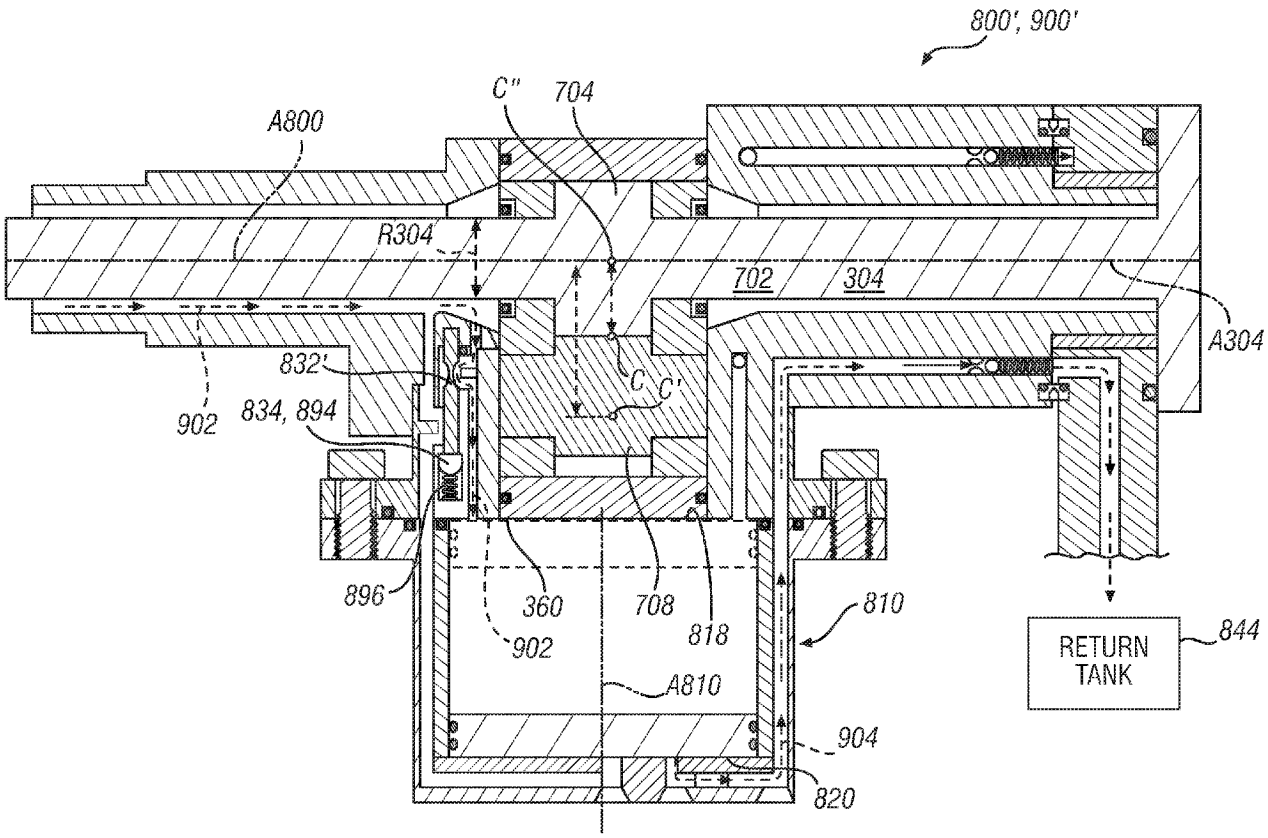
FIG. 15 is a side cross-sectional view of a device for controlling the movement of an eccentric mass according to another embodiment of the present disclosure using a control spool and a weight attached to the control spool that tends to move the control spool downward due to centrifugal force as the vibration mechanism rotates.
Figure 16:
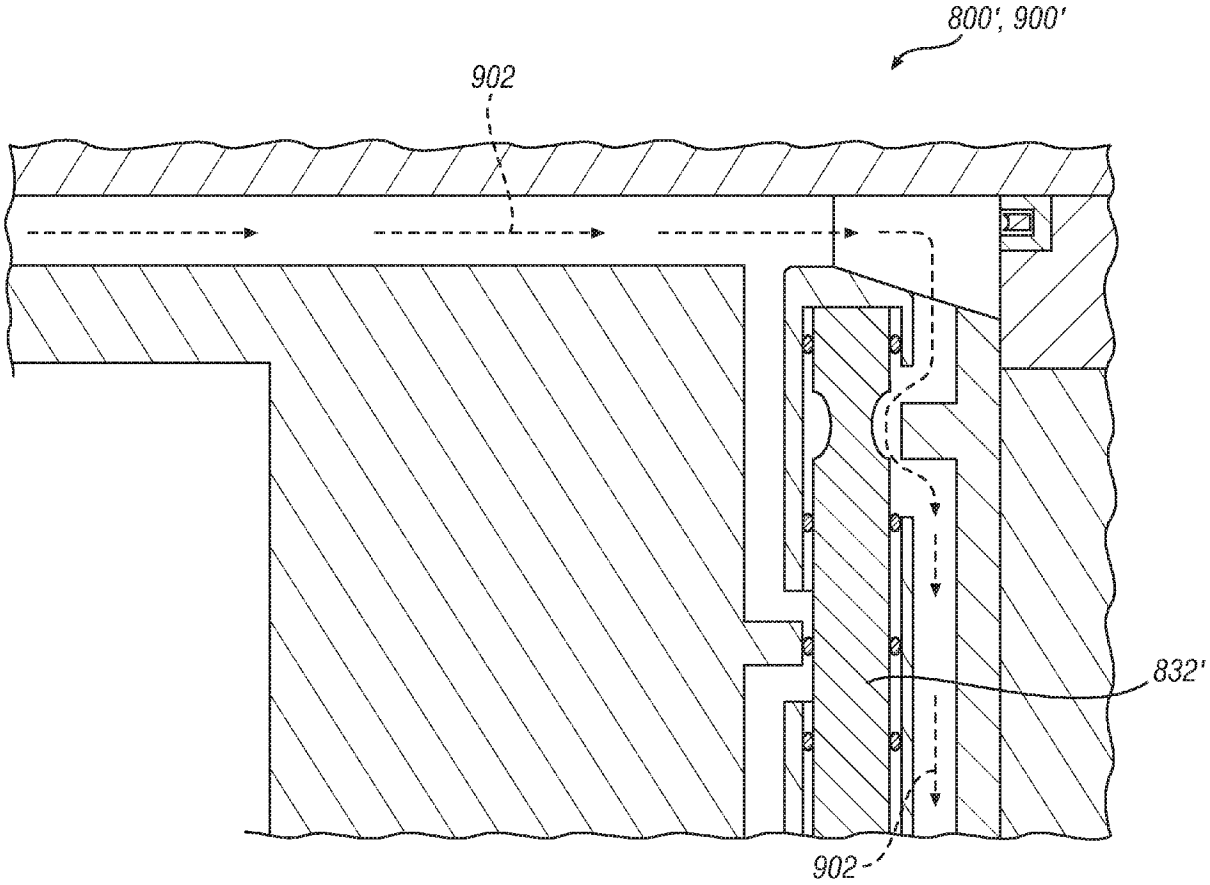
FIG. 16 is an enlarged detail view of the control spool of the device of FIG. 15, showing the control spool in an upper position where fluid is conveyed to the extend volume of a piston, moving the piston to its furthest position from the axis of rotation of the vibration mechanism.

Stage two of the operation of the apparatus 800 and associated hydraulic circuit 900 may be understood by looking at FIGS. 13 and 14. As the rate or speed of rotation of the apparatus 800 increases past a predetermined threshold, the centrifugal force exerted on the centrifugal moving member 834 will overcome the spring force of the governor mechanism 836, moving the sleeve 838 and the control spool 832 to a second position, where flow 902 through the first plurality of channels 804 stops and flow 906 through the second plurality of channels 806 begins. This exerts a hydraulic force on the piston 816 in the retract volume 820, overcoming the centrifugal force exerted on the piston 816, returning the piston 816 to its topmost position in FIG. 13. At the same time, fluid present in the extend volume 818 egresses through the third plurality of channels 842, overcoming the check valve 850, and is sent to the return tank 844. This process may reverse itself if the speed or rate of rotation of the apparatus decreases below the predetermined threshold.

FIGS. 15-18 depict another embodiment of the apparatus 800' and hydraulic circuit 900' that is similarly constructed and operated as the embodiment of FIGS. 11-14, except for the following differences. For this embodiment, the centrifugal moving member 834 is a weight 894 attached directly to the control spool 832' and the weight 894 and the control spool 832' are configured to move along a direction parallel with the longitudinal axis A810 of the hydraulic cylinder 810. A spring 896 biasing the weight 894 and the control spool 832' along the longitudinal axis A810 away from the hydraulic cylinder 810 is also provided. The weight 894 is positioned as far as possible away from the axis of rotation A800, to maximize its inertial effect on the movement of the spool 832'. When the apparatus 800' rotates slowly, then the spool 832' and the weight 894 are biased upwardly by the spring 896 to a first position (see FIGS. 15 and 16), allowing fluid flow 902 to reach the extend volume 818. At the same time, fluid 904 exits the retract volume 820 of the cylinder 810. When the apparatus 800' rotates faster than a predetermined threshold, the weight 894 and spool 832' move downwardly to a second position (see FIGS. 17 and 18), where fluid 906 flows into the retract volume 820 and fluid 908 exits the extend volume 818 of the cylinder 810. Since the spool and centrifugal moving member are contained in the housing, there is a lower likelihood that debris or the like could interfere with the governor mechanism.

Figure 17:
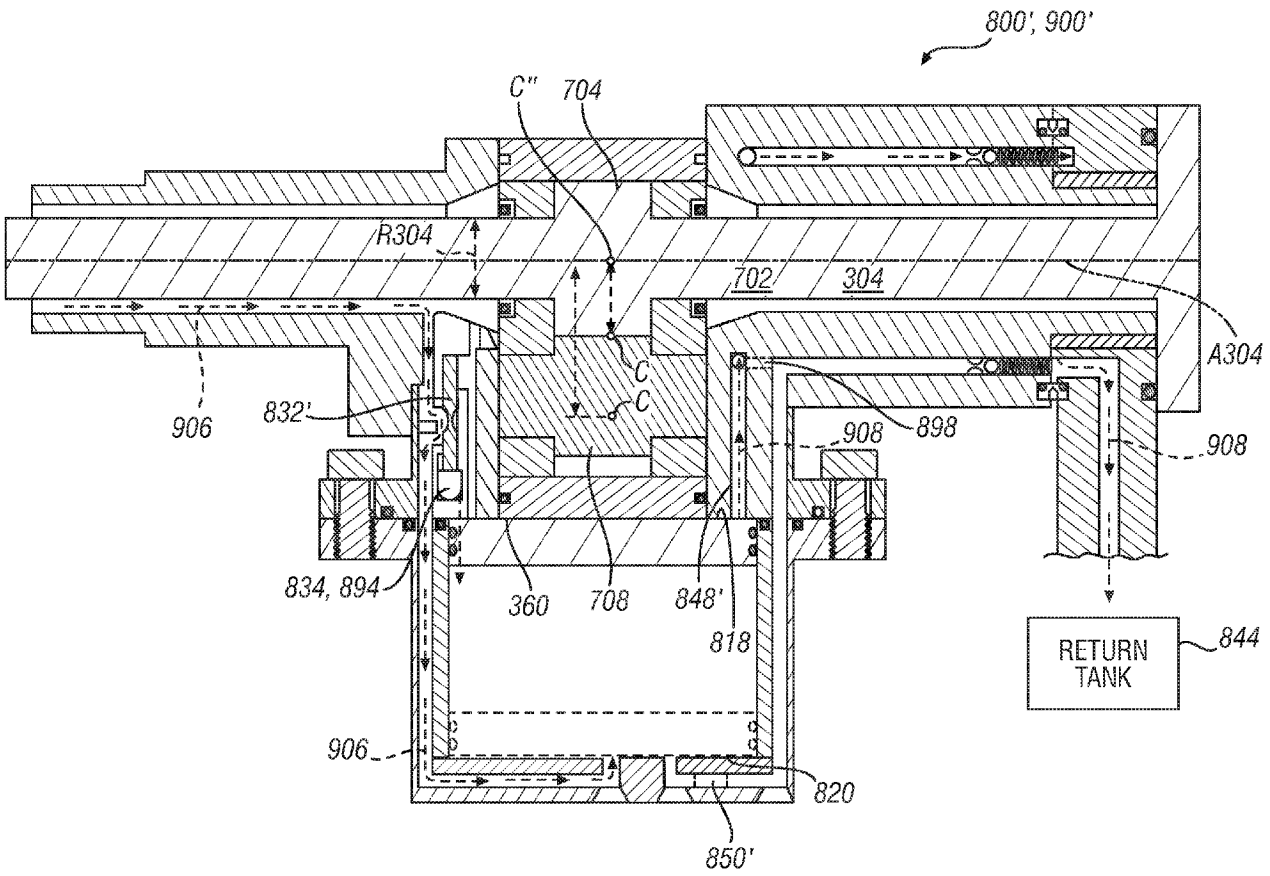
FIG. 17 is a side cross-sectional view of the device of FIG. 15 where the control spool has been moved to a lower position by the weight as it moves downward due to centrifugal force as the vibration mechanism rotates faster.
Figure 18:
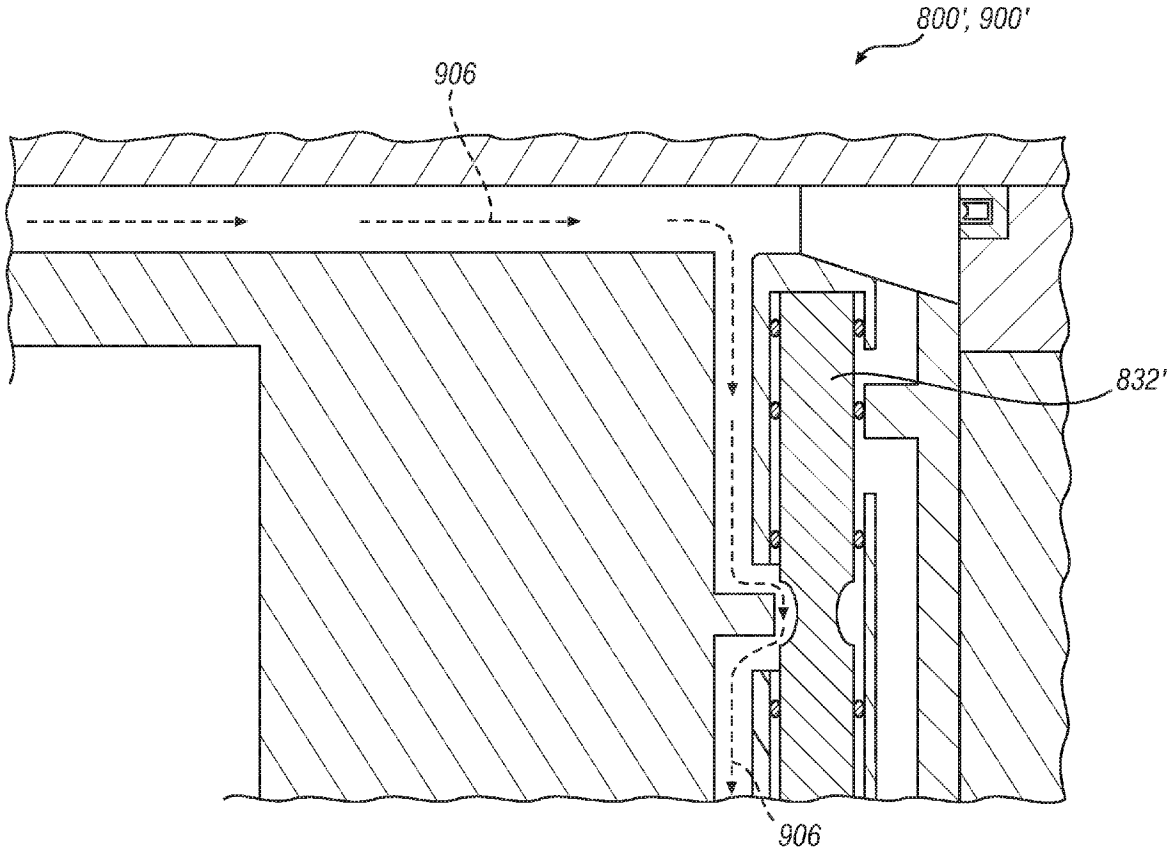
FIG. 18 is an enlarged detail view of the control spool of FIG. 17, showing the control spool in the lower position where fluid is conveyed to the retract volume side of the piston, moving the piston to its closest position from the axis of rotation of the vibration mechanism.

FIG. 17 illustrates an alternate arrangement of the third plurality of channels and fourth plurality of channels. Alternate positions of check valves 848' and 850' as well as a connecting bore 898 make the cross-bore/annular channel 854, and upper channel 856, etc. unnecessary.

Figure 19:
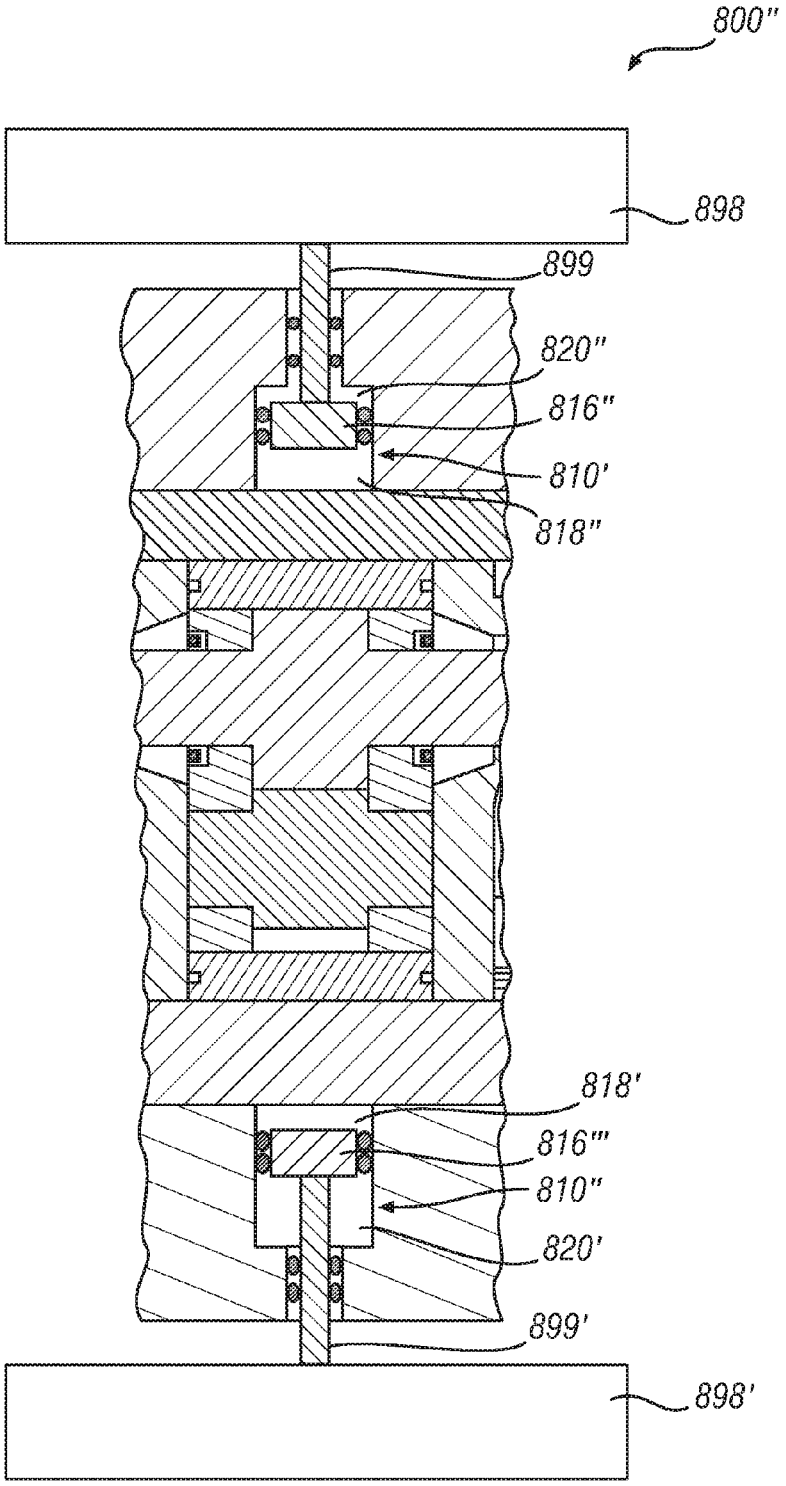
FIG. 19 illustrates another embodiment of an apparatus for controlling the position of an eccentric mass from the axis of rotation of a mechanism using two hydraulic cylinders and two eccentric masses.

FIG. 19 shows an embodiment of an apparatus 800" that uses two hydraulic cylinders 810', 810" that are attached to two different eccentric masses 898, 898'. More specifically, an upper mass 898 is attached to a first piston 816" of a first hydraulic cylinder 810' through a first rod 899 while a lower mass 898' is attached to a second piston 816'" of a second hydraulic cylinder 810" via a second rod 899'. The apparatus and control spool, governing mechanism, etc. may be constructed similar to any of the embodiments discussed herein with reference to FIGS. 11 thru 18. For example, the same control spool may send fluid to the extend volume 818' of the second hydraulic cylinder 810" while it sends fluid to the retract volume 820" of the first cylinder 810', maximizing the amplitude of the vibrations of the apparatus. On the other hand, the same control spool may send fluid to the extend volume 818" of the first hydraulic cylinder 810' and to the retract volume 820' of the second hydraulic cylinder 810" to minimize the amplitude of the vibrations of the apparatus. Alternatively, different control spools could be employed to control the fluid directed to the different hydraulic cylinders, etc.

Also, the timing of one cylinder relative to another may be adjusted by using multiple hydraulic circuits, control spools and governor mechanisms. That is to say, the second hydraulic cylinder may extend the second eccentric mass while the first hydraulic cylinder retracts the first eccentric mass. Then, the second hydraulic mechanism may retract the second eccentric mass until it cannot be retracted anymore. At that time, the first eccentric mass may be extended until the amplitude of the vibrations are minimized. This timing may be varied by altering the positioning of the governor mechanisms or control spools, the weight of the centrifugal moving member, or the strength of a spring associated with the governor mechanism, or the strength of a spring associated with a check valve, etc. Also, other variables such as the weight of the masses, dimensions of the cylinders, etc. may be varied to obtain the desired performance of the apparatus.

It is further contemplated that the top hydraulic cylinder of FIG. 19 may be positioned on one side of the housing along the axis of rotation and the bottom cylinder of FIG. 19 may be positioned on the other side of the housing along the axis of rotation. This may allow a natural decrease in the eccentricity of the center of mass afforded by the cylinders, which may be desirable in some applications.

In some applications, a plurality of check valves that are in fluid communication with the same extend or the same retract volume having different opening pressure settings may be employed. The plurality of check valves may be in fluid communication with either volume in a series or parallel arrangement. That is to say, they may be disposed in a single flow passage that leads from that volume or in separate flow passages that lead from that volume. This may allow fluid to slowly egress from that a volume so that more precise control of the movement of the piston, and the eccentric mass associated with the piston may be provided. For example, it may be desirable to allow the eccentric mass to move rapidly radially outward when the vibration mechanism is turned on while it may be desirable to move the eccentric mass more slowly inwardly as the speed of the mechanism increases. The rate of inward movement may be linear, logarithmic or exponential, etc. by providing suitably configured check valves.

INDUSTRIAL APPLICABILITY

In practice, a mechanism, a vibration mechanism, apparatus for controlling the movement of an eccentric mass or component or subassembly thereof, or a vibratory plate compactor assembly according to any of the embodiments as discussed herein may be manufactured, sold or attached to a machine as described herein. This may be done in an aftermarket or OEM context, that is to say, the mechanism, vibration mechanism, apparatus, component, subassembly or vibratory plate compactor assembly may be sold originally with a machine or be attached to the machine later after the original purchase of the machine. Similarly, a machine may originally be equipped or configured to use any of the embodiments of a mechanism, vibration mechanism, apparatus, subassembly or component thereof, or a vibratory plate compactor assembly as described herein or be retrofitted with the ability to use such assemblies. When not used to create vibration, the mechanism may be used to create a rotating or oscillating joint, etc.

It is contemplated that the yoke bushing member may be subject to wear and therefore need replacement. Therefore, the yoke bushing may be manufactured, sold or otherwise obtained to be supplied as a replacement part.

Figure 10:
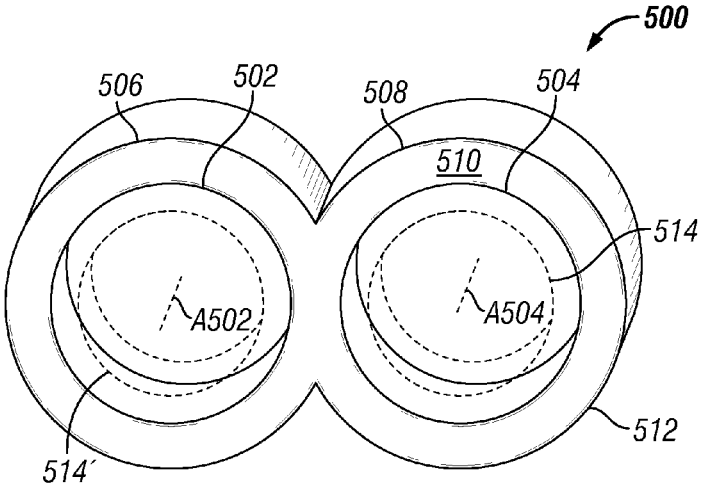
FIG. 10 is a perspective view of a yoke bushing member according to an embodiment of the present disclosure.

FIG. 10 illustrates the yoke bushing member 500 shown in isolation from any mechanism or assembly. As shown, the yoke bushing member 500 comprises a first yoke portion 506 defining a first cylindrical bore 502 that defines a first cylindrical axis A502 and a second yoke portion 508 defining a second cylindrical bore 504 that defines a second cylindrical axis A504. The second yoke portion 508 is connected to the first yoke portion 506 and the axes A502, A504 are parallel. The yoke bushing member 500 defines a plane 510 perpendicular to the cylindrical axes A502, A504, and the first and the second yoke portions 506, 508 of the yoke bushing member 500 defining an outer perimeter 512 in the plane 510 that has a substantial figure eight configuration. Hence, the yoke bushing member 500 is complimentary shaped to the perimeter 332 of the housing chamber 322 to fit snugly therein (see FIG. 6).

In some embodiments, the yoke bushing member comprises a bronze material. A bearing 514 may be pressed into either cylindrical bore.

A particular hydraulic circuit 400 will now be described with reference to FIGS. 6-8 that is compatible with any of the assemblies or mechanisms described herein. It is to be understood that the manifold of the compactor assembly receives pressurized fluid from the machine through hydraulic hoses shown in FIGS. 1 and 2 as previously described herein. Conduits then convey the fluid to the mechanism and back from the mechanism.

An exemplary hydraulic circuit 400 could begin with stage one flow (see arrows 402 in FIGS. 7 and 8) as the hydraulic fluid flows through conduit 622 and enters the fitting 620 into a hydraulic inlet channel 614. The fluid then passes through the cross-bore 618 and into the central bore 312 of the first axle portion 312. The fluid would continue to flow down this bore 318 until it reaches a diverging channel 364 just before the flow enters the housing 302. At the diverging channel 364, the flow would slow down, helping to facilitate the powering of the planetary gear 328 once the flow reaches it. This ends stage one of the flow.

Stage two flow (see arrows 404 in FIGS. 6 and 7) begins as the fluid enters the fifth bore 348, transitions to the third bore 344, and enters the first bore 340. As best seen in FIG. 6, the flow is forced toward the gears 324, 328 because the first bore 340 is sealed by a plug 366. As the flow approaches the fixed gear 324, the flow would push on the teeth of the fixed gear 324 with no effect as the fixed gear 324 is prevented from moving due to the attachment of the flag plate 612 to the stationary shaft 304 and the support plate 604. For this embodiment, the shaft 304 is integral with the fixed gear 324, preventing its movement as well. However, the fluid pressure would also press on the teeth 336 of the planetary gear 328, forcing movement of the gear and teeth in a counterclockwise direction, causing the planetary gear 326 to crawl about the fixed gear 324. This causes the housing 302 to also rotate about axis A304 in the same direction. Movement upwards of the housing causes the compacting plate to move up while movement downward causes the compacting plate to move downward. The fluid 404 passes through the annular channel 338 until it reaches the second bore 342. At that time, the flow 404 would enter the fourth bore 346 into the sixth bore 350 just before reaching the converging channel 368, increasing the speed of the flow. This would end the second stage of the flow.

Stage three flow (see arrows 406 in FIGS. 7 and 8) begins as the fluid enters the converging section 368 of the central bore 318 of the second axle portion 316. This converging section speeds up the flow of the hydraulic fluid. The fluid passes along this bore 318 until it reaches the cross-bores 618' and enters into the hydraulic outlet 616. It then flows out the fitting 620' and conduit 622' and returns back to the manifold.

Of course, it is contemplated that the flow of this hydraulic circuit could be reversed in other embodiments. Additionally, other circuits that use the embodiments of a mechanism or assembly as described herein could be created as needed or desired. Furthermore, other fluids other than hydraulic fluid could be used such as air, oil, etc. It is also contemplated that the flow could be periodically reversed to create an oscillating motion of the housing, etc.

Referring now to FIGS. 4, 7 and 8, a particular construction and manner of assembling the mechanism 300 will now be explained. The exterior of the mechanism 300 is formed by two identically configured cap members 370 that sandwich a core member 372 between them. The cap members 370 are attached to each other using tie rods 374 in a manner known in the art. The cap members 370 include and end plate 376 and a tube structure 378 extending from the end plate 376 that forms the axle portion 310, 316 of the mechanism 300. The tube structure 378 is integral with the end plate 376 being machined from the same component or being cast together. The core member 372 defines the housing chamber 322 and may also be machined from a single component or be cast.

As best seen in FIGS. 7 and 8, a first set of seals 380 are disposed between the stationary shaft 304 and the yoke bushing member 500 to help prevent fluid from bypassing the central chamber 332 by escaping along the shaft 304. This would decrease the power output of the mechanism. A second set of seals 382 are disposed between the cap members 370 and the core member 372 to prevent fluid from passing between them. Although not shown in FIG. 8, face seals may be disposed at the interface 384 between the rotating axle portions 310, 316 and the support plates 604, 608. This would allow movement between the axle portions and the support plates while still preventing fluid from leaking between these components.

Figure 20:
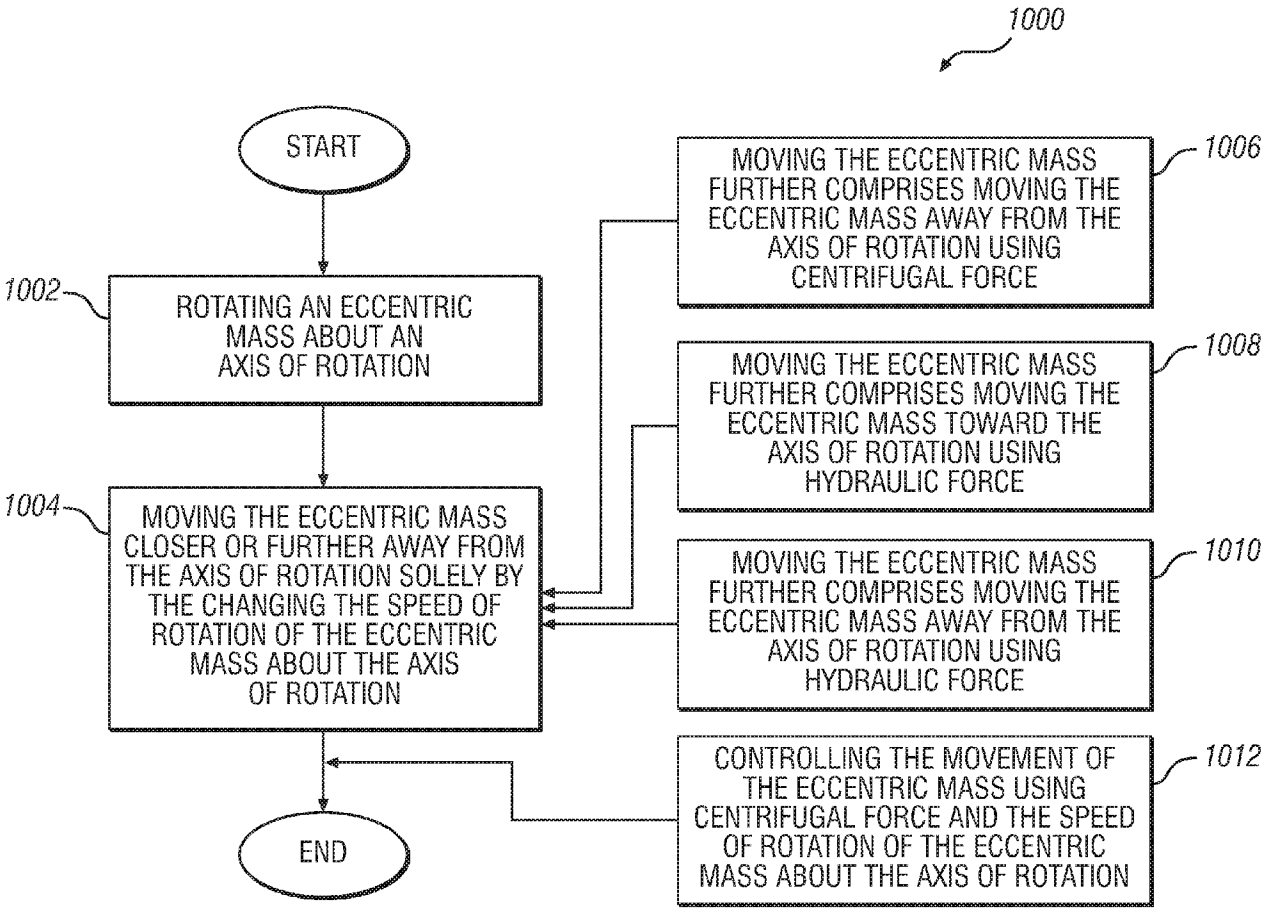
FIG. 20 is a flowchart of a method for adjusting the position of an eccentric mass from the axis of rotation of a mechanism using only the shaft speed.

FIG. 20 is a flowchart of a method for adjusting the position of an eccentric mass from the axis of rotation of a mechanism using only the shaft speed. The method 1000 comprises rotating an eccentric mass about an axis of rotation (see step 1002), and moving the eccentric mass closer or further away from the axis of rotation solely by the changing the speed of rotation of the eccentric mass about the axis of rotation (step 1004).

In some embodiments, moving the eccentric mass further comprises moving the eccentric mass away from the axis of rotation using centrifugal force (see step 1006). In other embodiments, moving the eccentric mass further comprises moving the eccentric mass toward the axis of rotation using hydraulic force (see step 1008). In yet further embodiments, moving the eccentric mass further comprises moving the eccentric mass away from the axis of rotation using hydraulic force (see step 1010).

In some applications, the method may further comprise controlling the movement of the eccentric mass using centrifugal force and the speed of rotation of the eccentric mass about the axis of rotation (see step 1012).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An apparatus for controlling the movement of an eccentric mass of a mechanism, the apparatus comprising:

a housing defining a first plurality of channels and a second plurality of channels lacking fluid communication with the first plurality of channels within the housing;

a shaft defining an axis of rotation for the apparatus; and a hydraulic cylinder defining an interior space and a longitudinal axis perpendicular to the axis of rotation, the cylinder being attached to the housing, the cylinder including a piston disposed in the interior space of the cylinder and configured to move along the longitudinal axis;

wherein the piston divides the hydraulic cylinder into extend and retract volumes and the first plurality of channels is at least partially in fluid communication with the extend volume and the second plurality of channels is at least partially in fluid communication with the retract volume.

2. The apparatus of claim 1 further comprising a control spool in fluid communication with the first and second plurality of channels, and a centrifugal moving member in operative association with the control spool, wherein the centrifugal moving member is configured to move the control spool.

3. The apparatus of claim 2 further comprising a centrifugal governor mechanism including the centrifugal moving member, a sleeve connected to the control spool, and a spring, wherein the control spool and the sleeve are configured to move in a direction parallel with the axis of rotation.

4. The apparatus of claim 2 wherein the centrifugal moving member is a weight attached directly to the control spool and wherein the weight and the control spool are configured to move along a direction parallel with the longitudinal axis of the hydraulic cylinder.

5. The apparatus of claim 1 further comprising a return tank and wherein the housing further defines a third plurality of channels in fluid communication with the extend volume and the return tank and a fourth plurality of channels in fluid communication with the retract volume and the return tank.

6. The apparatus of claim 5, further comprising a first check valve disposed in the third plurality of channels and a second check valve disposed in the fourth plurality of channels.

7. The apparatus of claim 4 further comprising a spring biasing the weight and the control spool along the longitudinal axis away from the hydraulic cylinder.

8. The apparatus of claim 2 wherein the control spool is configured to move from a first position where the first plurality of channels are in fluid communication with the extend volume and the second plurality of channels at least partially lack fluid communication with the retract volume and a second position where the second plurality of channels are in fluid communication with the retract volume and the first plurality of channels at least partially lack fluid communication with the extend volume.

9. The apparatus of claim 1 wherein the shaft is a stationary shaft and the apparatus further comprises a rotating axle portion defining a central aperture and the shaft is disposed in the central aperture, creating an annular inlet that is in fluid communication with the first and second plurality of channels.

10. The apparatus of claim 1 wherein movement of the piston alters the distance from the center of gravity of the apparatus to the axis of rotation.

11. An apparatus for controlling the movement of an eccentric mass of a vibration inducing mechanism, the apparatus comprising:

an upper portion;

a lower portion that is movably attached to the upper portion and that includes a compacting plate, a first support plate defining a first bore, and a second support plate defining a second bore;

a vibration mechanism operatively associated with the lower portion for vibrating the lower portion; the mechanism including a rotating housing defining a first plurality of channels and a second plurality of channels lacking fluid communication with the first plurality of channels within the housing;

a stationary shaft defining an axis of rotation for the rotating housing, a first free end and a second free end;

a first axle portion extending from the rotating housing and defining a first central bore and a first free end;

a second axle portion extending from the rotating housing and defining a second central bore and a second free end; and a hydraulic cylinder defining an interior space and a longitudinal axis perpendicular to the axis of rotation, the cylinder being attached to the housing, the cylinder including a piston disposed in the interior space of the cylinder and configured to move along the longitudinal axis;

wherein the piston divides hydraulic cylinder into extend and retract volumes and the first plurality of channels is at least partially in fluid communication with the extend volume and the second plurality of channels is at least partially in fluid communication with the retract volume, and the shaft is disposed in the first central bore of the first axle portion, creating an annular inlet that is in fluid communication with the first and second plurality of channels.

12. The apparatus of claim 11 further comprising a first support bearing and a second support bearing, wherein the first axle portion defines a first outer circumference and the second axle portion defines a second outer circumference, and wherein the first support bearing is disposed about the first outer circumference spaced away from the housing and the second support bearing is disposed about the second outer circumference spaced away from the housing.

13. The apparatus of claim 12 wherein the housing defines a housing chamber, the assembly further comprising:

a fixed gear attached to the stationary shaft;

a rotating shaft and a planetary gear attached to the rotating shaft, the planetary gear meshing with the fixed gear; and a yoke bushing member defining a first aperture and a second aperture that are spaced away from each other a predetermined distance, wherein the stationary shaft is disposed in the first aperture of the yoke bushing member and the rotating shaft is disposed in the second aperture, and wherein the yoke bushing member, the rotating shaft, the fixed gear, the planetary gear and a portion of the fixed shaft are disposed in the housing chamber.

14. The apparatus of claim 13 wherein the housing defines a first bore that extends from the housing chamber in a first direction perpendicular to the axis of rotation, the housing further defining a second bore that extends from the housing chamber in a second direction that is opposite the first direction; and wherein the housing further defines a third bore extending in a third direction that is parallel to the axis of rotation and a fourth bore extending in a fourth direction that is opposite the third direction, wherein the third bore is in fluid communication with the first bore and the fourth bore is in fluid communication with the third bore; and wherein the housing further defines a fifth bore that extends in the same direction as the second bore, the housing further defining a sixth bore that extends in the same direction as the first bore, wherein the fifth bore is in fluid communication with the third bore and the sixth bore is in fluid communication with the fourth bore.

15. The apparatus of claim 12 further comprising a return tank and a support member surrounding a support bearing and wherein the housing further defines a third plurality of channels in fluid communication with the extend volume and the return tank and a fourth plurality of channels in fluid communication with the retract volume and the return tank, the support member defining at least one vent passage in fluid communication with the third plurality of channels or the fourth plurality of channels and the return tank.

16. The apparatus of claim 11 further comprising a control spool in fluid communication with the first and second plurality of channels, and a centrifugal moving member in operative association with the control spool, wherein the centrifugal moving member is configured to move the control spool.

17. The apparatus of claim 16 wherein the centrifugal moving member and the control spool are disposed adjacent the first axle portion and the support member defining the vent passage is disposed adjacent the second axle portion.

18. A method for adjusting the position of an eccentric mass from the axis of rotation of a mechanism comprising:

rotating an eccentric mass about an axis of rotation; and moving the eccentric mass closer or further away from the axis of rotation solely by the changing the speed of rotation of the eccentric mass about the axis of rotation.

19. The method of claim 18 wherein moving the eccentric mass further comprises moving the eccentric mass away from the axis of rotation using centrifugal force.

20. The method of claim 19 wherein moving the eccentric mass further comprises moving the eccentric mass toward the axis of rotation using hydraulic force.

* * * * *